United States Patent [19]

Bergeron

[11] 4,020,660

[45] May 3, 1977

[54] ROUGHING MACHINE HAVING TOOL POSITION ADJUSTING MECHANISM

[75] Inventor: Normand Bergeron, Boucherville, Canada

[73] Assignee: International Shoe Machine Corporation, Nashua, N.H.

[22] Filed: June 8, 1976

[21] Appl. No.: 694,005

Related U.S. Application Data

[63] Continuation of Ser. No. 608,616, Aug. 28, 1975, abandoned.

[52] U.S. Cl. ..... 69/6.5; 12/1 R; 12/77

[51] Int. Cl.[2] ..... C14B 1/44; A43D 95/00

[58] Field of Search ..... 12/1 R, 1 B, 1 F, 77, 12/70, 17 R, 17.2; 69/6.5; 51/98; 91/441

[56] References Cited

UNITED STATES PATENTS

| | | | |
|---|---|---|---|
| 3,077,098 | 2/1963 | Pearsall et al. | 69/6.5 |
| 3,298,048 | 1/1967 | Dziki et al. | 12/17 R |
| 3,400,561 | 9/1968 | Bechtold | 69/6.5 |
| 3,645,118 | 2/1972 | Babson | 69/6.5 |
| 3,843,985 | 10/1974 | Leonhardt | 12/1 R |

*Primary Examiner*—Patrick D. Lawson
*Attorney, Agent, or Firm*—Albert Gordon

[57] ABSTRACT

A roughing machine for roughing the margin of an upper of a shoe assembly comprised of a last having an insole on its bottom and the upper mounted thereon with the upper margin lying against and being secured to the insole periphery. The machine is so constructed as to enable a roughing tool to engage the upper margin a relatively great or a relatively small distance inwardly of the periphery of the shoe assembly bottom during movement of the upper margin past the roughing tool and the machine incorporates an automatically operable mechanism for placing the roughing tool in one or the other of these positions.

13 Claims, 27 Drawing Figures

ROUGHING MACHINE HAVING TOOL POSITION ADJUSTING MECHANISM

This is a continuation of application Ser. No. 608,616 filed Aug. 28, 1975, now abandoned.

BACKGROUND OF THE INVENTION

Each of U.S. Pat. Nos. 3,077,098, 3,298,048 and 3,843,985 discloses a roughing machince capable of roughing the margin of an upper of a shoe assembly comprised of a last having an insole located on its bottom and the upper mounted thereon with the upper margin lying aginst and being secured to the insole periphery. These machines are so constructed as to enable a roughing tool to engage the upper margin a relatively great or a relatively small distance inwardly of the periphery of the shoe assembly bottom during movement of the upper margin past the roughing tool.

In the machine of U.S. Pat. No 3,077,098 the roughing tool is caused to be displaced from a relatively great distance inwardly of the periphery of the shoe assembly bottom to a relatively small distance inwardly of the periphery of the shoe assembly bottom in response to the approach of the widest part of the shoe assembly bottom, which is at the ball break to the roughing tool so that the roughing tool roughs the upper margin at the relatively small distance inwardly of the shoe assembly bottom at the ball breaks and in the shank and forepart portions that are on opposite sides of the ball breaks.

In the machine of U.S. Pat. No. 3,298,048 the position of the roughing tool with respect to the periphery of the shoe assembly bottom is adjusted by manually operating a foot pedal.

In the machine of U.S. Pat. No. 3,843,985, the roughing tool is caused to be displaced from a relatively great distance inwardly of the periphery of the shoe assembly bottom to a relatively small distance inwardly of the periphery of the shoe assembly bottom during rotary motion of the toe portion of the upper margin past the roughing tool.

SUMMARY OF THE INVENTION

It has been found to be desirable to displace the roughing tool from a relatively great distance inwardly of the periphery of the shoe assembly bottom to a relatively small distance inwrdly of the periphery of the shoe assembly bottom during the movement past the roughing tool of the portion of the upper margin that extends between the regions of the ball breaks and the toe end extremity of the upper margin. This invention provides a machine that automatically performs this displacement between the regions of the ball breaks and the toe end extremity of the upper margin or between any other desired portions of the upper margin.

As with the machine of U.S. Pat. No. 3,843,985, the machine of this invention incorporates a housing, a roughing tool mounted to the housing for forward-rearward movement, drive means for moving the roughing tool between forward and rearward positions with respect to the housing, a table, a slide mounted to the table for movement with respect to the table, a shoe assembly support mounted to the slide for supporting a shoe assmebly bottom-up, shoe assembly support moving means that includes means for moving the slide with respect to the table to thereby move portions of the upper margin past the roughing tool, and operating means effective during the movement of the upper margin portions past the roughing tool to cause such movements of the housing as to enable the roughing tool to engage the upper margin a relatively great distance inwardly of the periphery of the shoe assembly bottom when the roughing tool is in said forward position and to enable the roughing tool to engage the upper margin a relatively small distance inwardly of the periphery of the shoe assembly bottom when the roughing tool is in said rearward position.

The machine of U.S. Pat. No. 3,843,985 has been modified, in accordance with this invention, by providing a control member mounted to the table and an actuator member mounted to the slide. These members are so constructed and arranged as to be in intersecting relationship or non-intersecting relationship during the operation of the shoe assembly support moving means. Adjusting means are incorporated in the machine that so connect the members to the drive means as to cause the drive means to place the roughing tool in one of its positions when the members are in non-intersecting relationship and to place the roughing tool in the other of its positions when the members are in intersecting relationship.

DESCRIPTION OF THE PREFERRED EMBODIMENT

Figure 1:
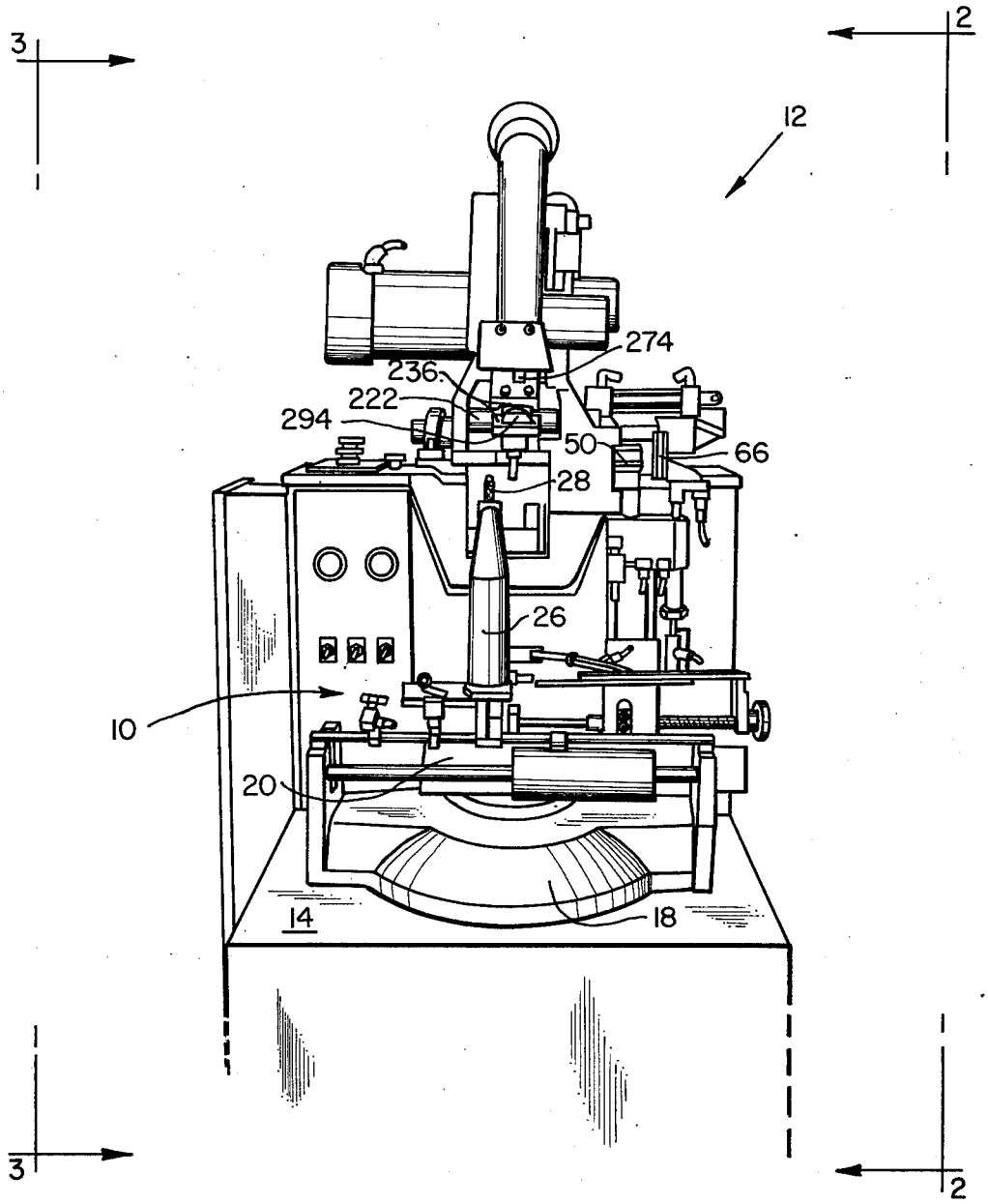
FIG. 1 is a front elevation of the machine.
Figure 2:
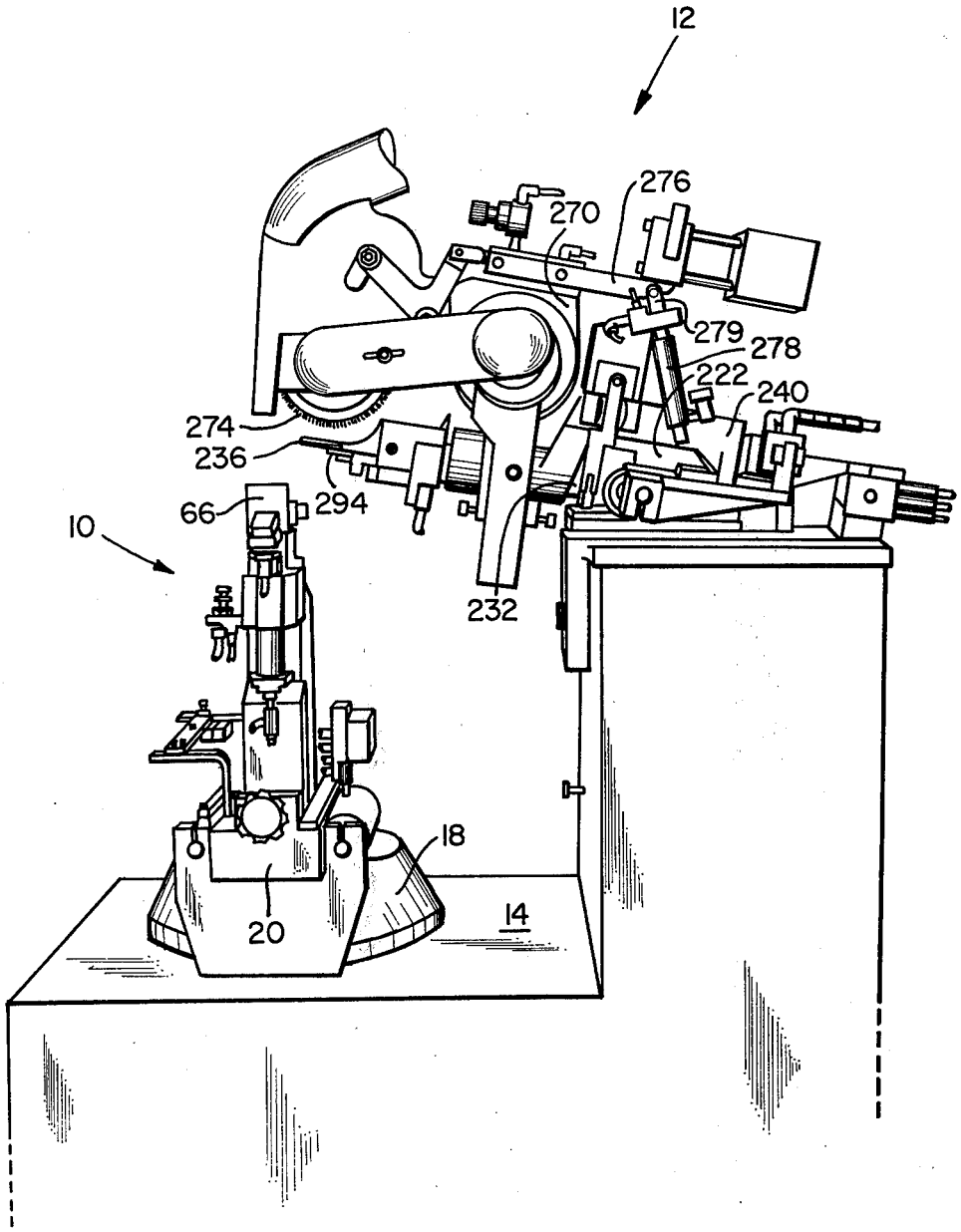
FIGS. 2 and 3 are side elevations of the machine respectively taken along the lines 2—2 and 3—3 of FIG. 1.
Figure 3:
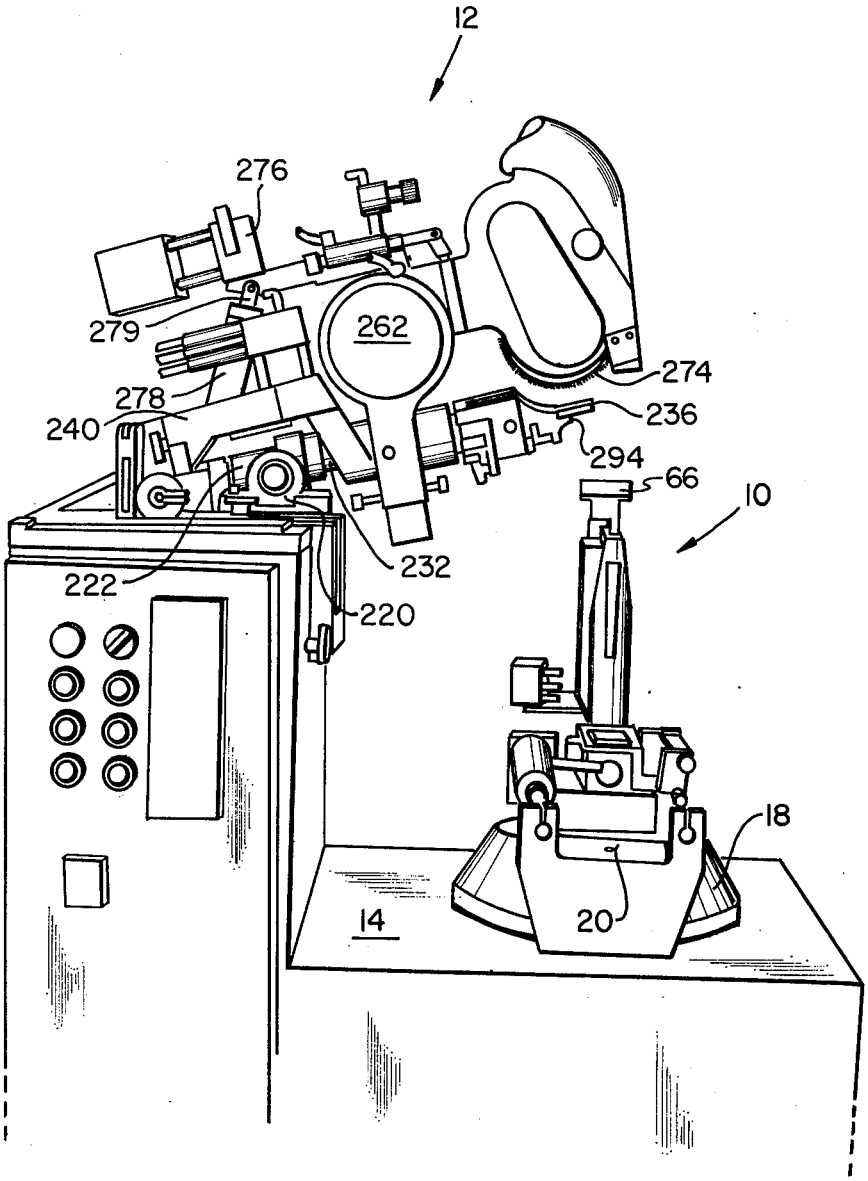

The operator is intended to stand in front of the machine as seen in FIG. 1, to the left of the machine as seen in FIG. 2 and to the right of the machine as seen in FIG. 3. Directions extending toward the operator will be designated as "forward" and directions extending away from the operator will be designated as "rearward". The front of the machine is closest to the operator and the back of the machine is furthermost from the operator.

The machine, as shown in FIGS. 1–3, includes a shoe assembly mount section 10 and a tool section 12 located rearwardly of the section 10.

Figure 4:
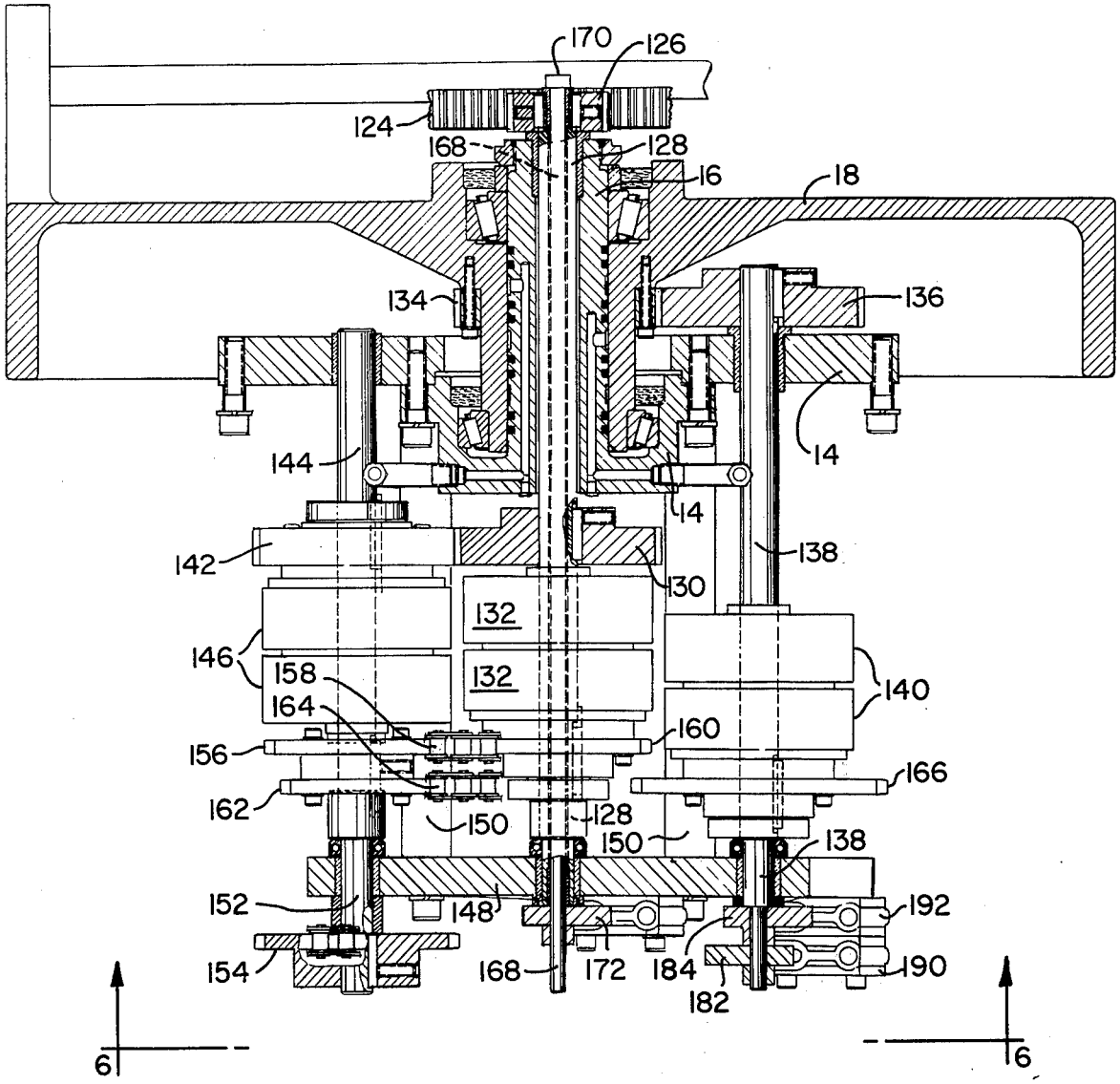
FIG. 4 is a section of the table of the machine showing mechanisms for causing the slide to move with respect to the table and for causing the table to rotate.

Referring to FIG. 4, the section 10 includes a stationary base 14 having a stationary sleeve 16 upstanding therefrom. A turnable 18 is mounted to the base 14 and the sleeve 16 for rotation in a horizontal plane. As shown in FIGS. 7–10, a slide 20 is slidably guided in the turntable 18 for recipocating motion in a horizontal plane by means of bushing 22 on the slide 20 that are slidable on rods 24 that are affixed to and extend across the top of the turntable 18.

Referring to FIGS. 7–10, a post 26 is rigidly mounted to the slide 20 and a last pin 28, that acts as a shoe assembly supporting element, extends upwardly of the post 26. An air operated motor 30 is rigidly mounted to the the post 26. The piston rod 32 of the motor 30 is secured to one end of a bracket 34 and a bolt 36 is rotatably mounted to the other end of the bracket 34. The bolt is threaded into a stand 38 and a knob 40 is affixed to the end of the bolt 36 that is remote from the bracket 34. The stand 38 is slidably guided, by means of gibs 42, in the slide 20 for reciprocating motion in directions that are parallel to the directions of reciprocating motion of the slide 20 in the turntable 18.

The stand 38 incorporates an air operated motor 44 that includes a cylinder 46 and an upwardly extending and vertically movable piston rod 48. A toe pad 50, that acts as a shoe assembly supporting element, is affixed to the top of the piston rod 48. The stand 38 also incorporates an air actuated motor 52 that includes a cylinder 54 in the stand and a downwardly extending vertically moveable piston rod 55. A brake pad 56 is affixed to the bottom of the piston rod 55 and is in registry with flat surface 58 of the slide 20.

Another air operated motor 60, mounted to the stand 38, has a piston rod 62 extending upwardly thereof. A clevis 64, at the top of the piston rod 62, pivotally mounts a toe stop 66 for swinging movement about the axis of a pin 68. The toe stop 66 is located adjacent to the toe pad 50 and on the opposite side of the toe pad 50 from the last pin 28. A ledge 70 is mounted to the clevis 64 and a compression spring 72 interposed between the ledge 70 and a lug 74 affixed to the toe stop 66 yieldably urges the toe stop 66 counterclockwise (FIG. 7) about the axis of the pin 68. A valve 76, mounted to the ledge 70, is in registry with a cam surface 78 on the lug 74, the spring 72 normally yieldably urging the cam surface 78 upwardly and away from the spool of the valve 76.

A bracket 80 is so rotatably mounted to an unthreaded portion of the bolt 36 adjacent to the knob 40 that the bracket is not moveable along the longitudinal axis of the bolt. The bracket 80 is slidably mounted in the slide 20 by means of flanges 82 slidable in the gibs 42. A plate 84 is fixed to the bracket 80 and extends horizontally from the bracket 80 towards the post 26 over the slide 20. A bracket 86 is fixed to the gibs 42 of the slide 20 in such a manner as to straddle the piston rod 32. A link 88 is pivoted to a post 90 that is upstanding from the bracket 86. The link 88 is pivoted by a pin 92 to a link 94. The link 94 is pivoted intermediate its ends by a pin 96 to a flange 98 of the plate 84.

A beam 100 is located beneath the plate 84 and is slidably mounted to the plate 84 for movement lengthwise of the slide 20 by means of a pair of bolts 102 that are threaded into the beam 100 and extend upwardly thereof through a longitudinal slot 104 in the plate 84. The bolts 102 are movable in the slot 104 and washers 106 interposed between the heads of the bolts 102 and the top of the plate 84 retain the beam 100 against the bottom of the plate 84. A pin 108 extending upwardly of the beam 100 through the slot 104 is slidably received in a slot 110 in the end of the link 94 remote from the pin 92 and on the opposite side of the pin 96 as the pin 92.

A pair of posts 112 are rigidly secured to a rod 114 that is so mounted to the turntable 18 as to extend lengthwise of the slide 20. A bolt 116 extends between and is rotatably mounted in the posts 112 and a bar 118 is fixedly mounted to the posts 112 so as to extend alongside the bolt 116. A valve mount 120 is threaded onto the bolt 116 and is slidably mounted in the bar 118 whereby rotation of the bolt 116 by a knob 121 can effect movement of the valve mount 120 lengthwise of the bolt 116 towards and away from the beam 100. A valve 122 is so mounted to the valve to the valve mount 120 as to be in registration with a valve actuating cam 123 that is mounted to the end of the beam 100 that is remote from the bracket 80.

A rack 124 (FIGS. 4 and 9), mounted to the bottom of the slide 20, is in mesh with a gear 126. The gear 126 is fixed to a shaft 128 (FIG. 4) that depends from and is rotatable in the sleeve 16. The turntable 18 is rotable about the vertical axis of the sleeve 16. A gear 180 is secured to the shaft 128 below the base 14 and, below the gear 130, the shaft 128 is affixed to an upper element of a pneumatically operated clutch 132 and extends through the lower element of this clutch.

a gear 134, secured to the turntable 18, is in mesh with a gear 136 that is rigidly secured to a shaft 138. The shaft 138, which is rotatably mounted in and extends below the base 14, is affixed to an upper element of a pneumatically operated clutch 140 and extends through the lower element of the clutch 140.

The gear 130 is in mesh with a gear 142 that is rigidly mounted to a shaft 144. The shaft 144 is rotatably mounted in and extends below the base 14 and is affixed to an upper element of a pneumatically operated clutch 146.

A plate 148 is located below the base 14 and is secured to the base 14 by columns 150. A drive shaft 152, connected by a gear 154 to a source of power (not shown), is rotatably mounted in the plate 148 and is connected to the lower element of the clutch 146. The bottoms of the shafts 128 and 138 are also rotatably mounted in the plate 148. A sprocket 156 secured to the shaft 152 is drivingly connected by a chain 158 to a sprocket 160. The sprocket 160 is rotatably mounted to the shaft 128 and is secured to the lower element of the clutch 132. A sprocket 162 secured to the shaft 152 is drivingly connected by a chain 164 to a sprocket 166. The sprocket 166 is rotatably mounted to the shaft 138 and is secured to the lower element of the clutch 140.

Figure 6:
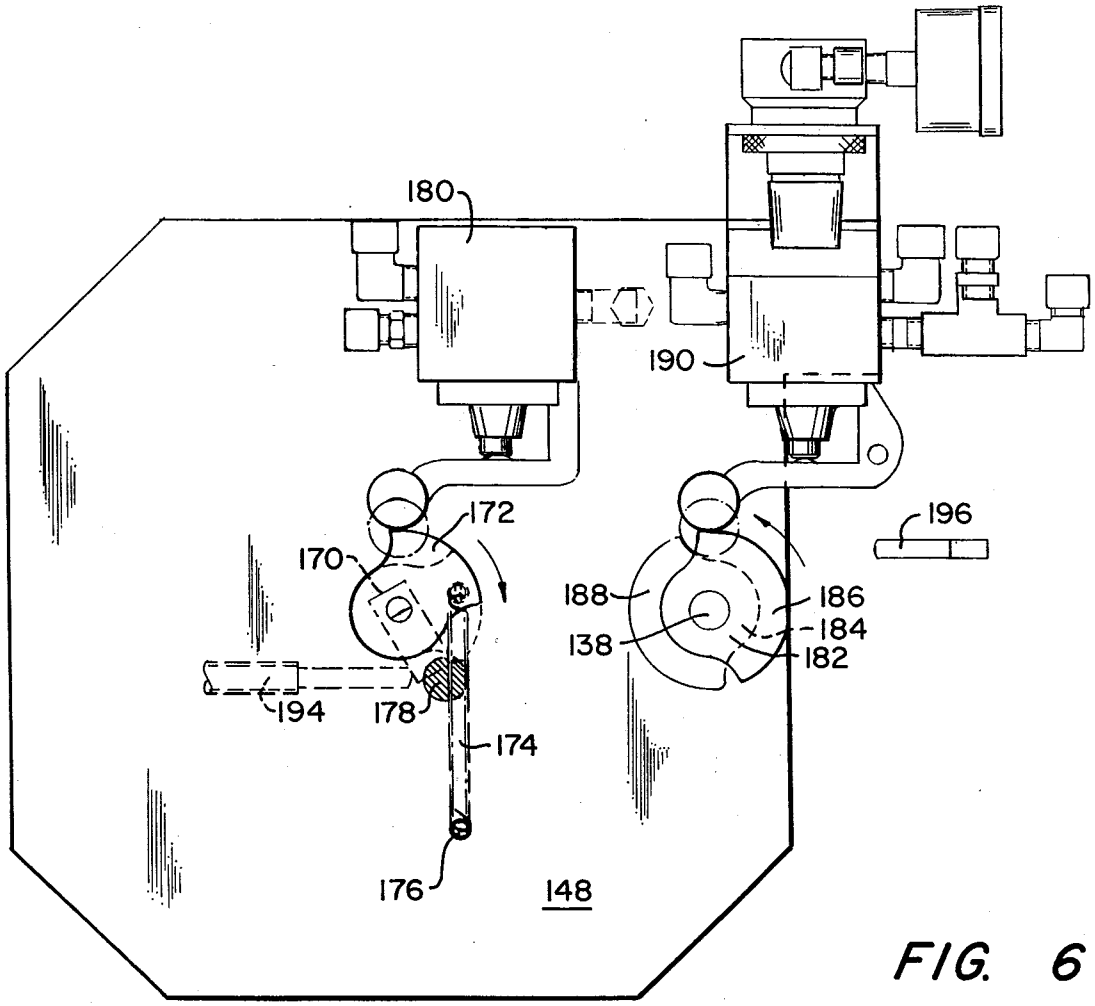
FIG. 6 is bottom plan view taken along the line 6—6 of FIG. 4 with some of the parts shown in FIG. 4 omitted.
Figure 9:
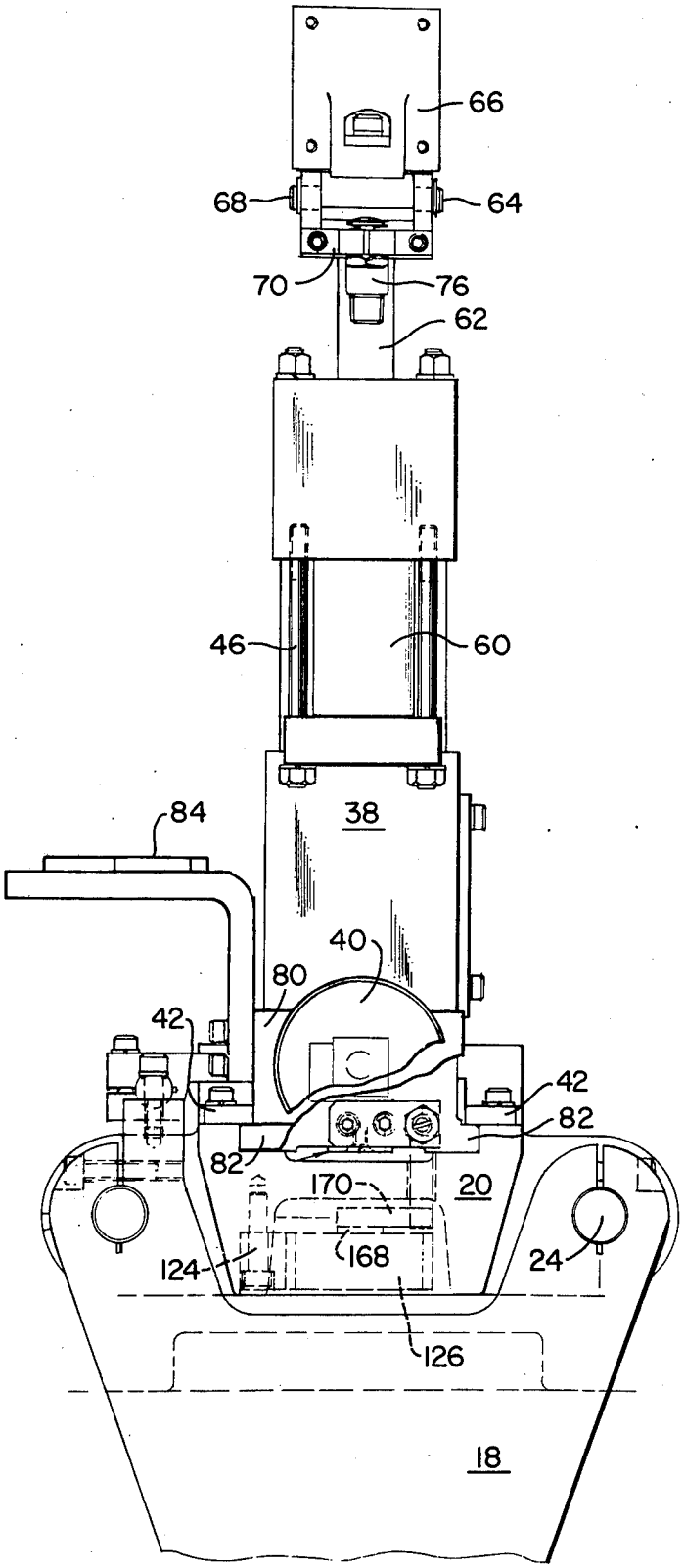
FIGS. 9 and 10 are views respectively taken along the lines 9—9 and 10—10 of FIG. 7.
Figure 10:
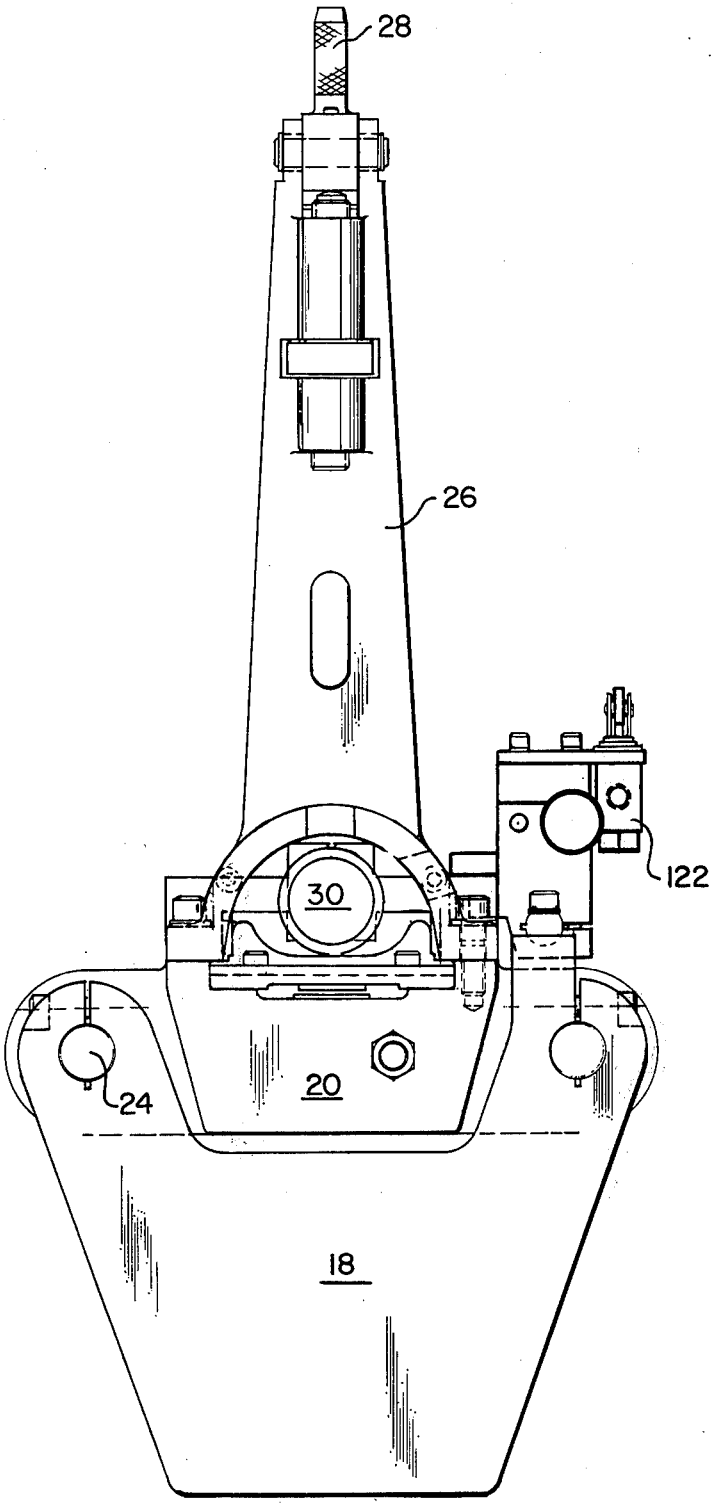

Referring to FIGS. 4, 6 and 9, a shaft 168 extends through and is rotatably mounted in the shaft 128 and the clutch 132. An arm 170 is secured to the top of the shaft 168 and is located above the tops of the rack 124 and the gear 126. A cam 172 is secured to the bottom of the shaft 168 and is located below plate 148. A tension spring 174, connected to and extending between the cam 172 and a clip 176 secured to the plate 148, yieldably urges the cam 172, together with the shaft 168 and the arm 170, about the axis of the shaft 168 to a position wherein the cam 172 abuts a pin 178 that is secured to and depends from the plate 148. A valve 180 is mounted to the plate 148 and is so located as to be actuated by the cam 172 when the cam 172 is moving about the axis of the shaft 168 and away from its position of abutment with the pin 178. A pair of cams 182 and 184 having radially projecting cam lobes 186 and 188 are mounted to the bottom of the shaft 138 below the plate 148. The cam lobe 186 is in intersecting relationship, during rotation of the shaft 138, with a valve 190 and the cam lobe 188 is in intersecting relationship, during rotation of the shaft 138, with a valve 192. The valves 190 and 192 are mounted to the plate 148.

Figure 7:
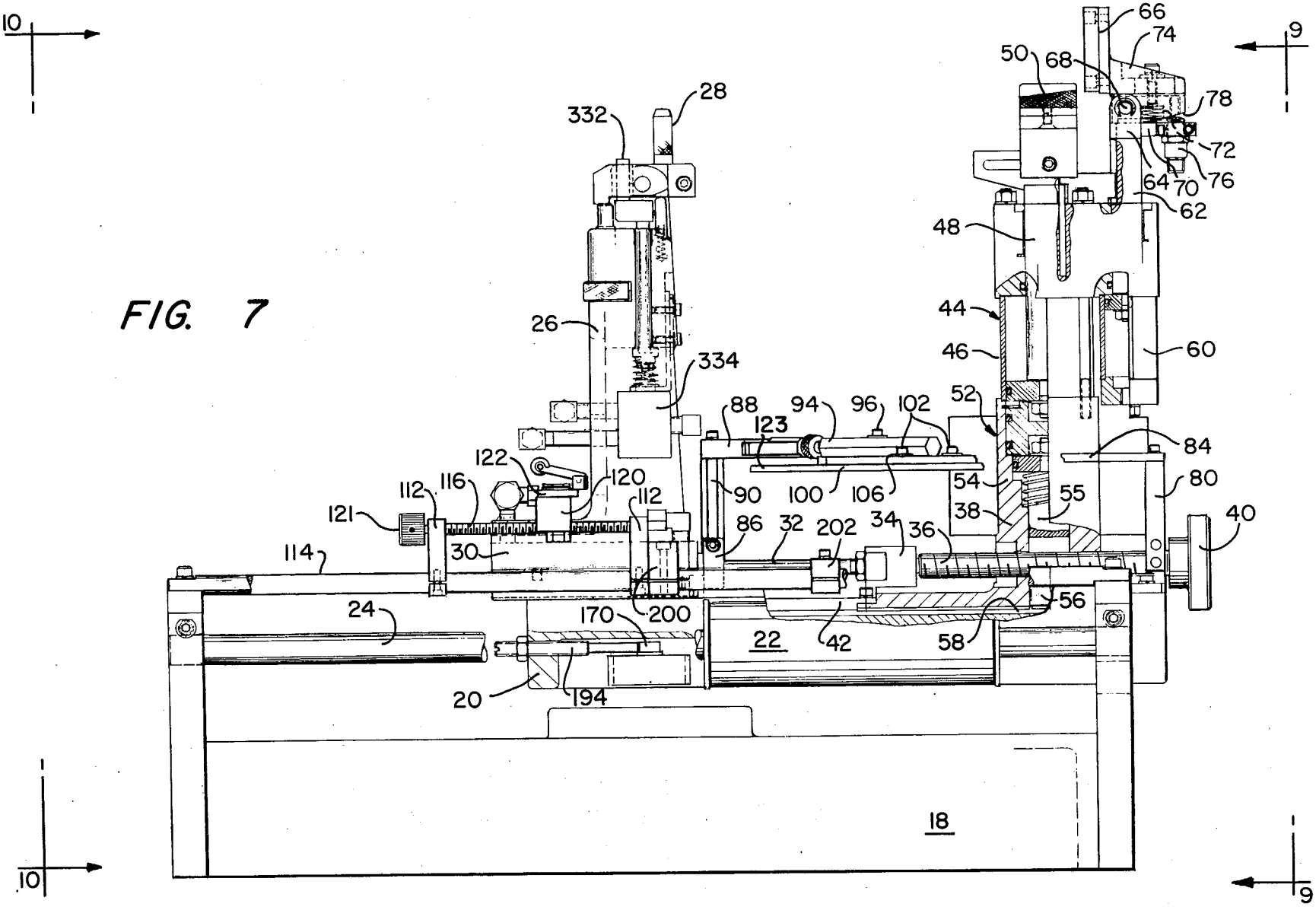
FIG. 7 is an elevation of the table, the slide and the shoe assembly support.
Figure 8:
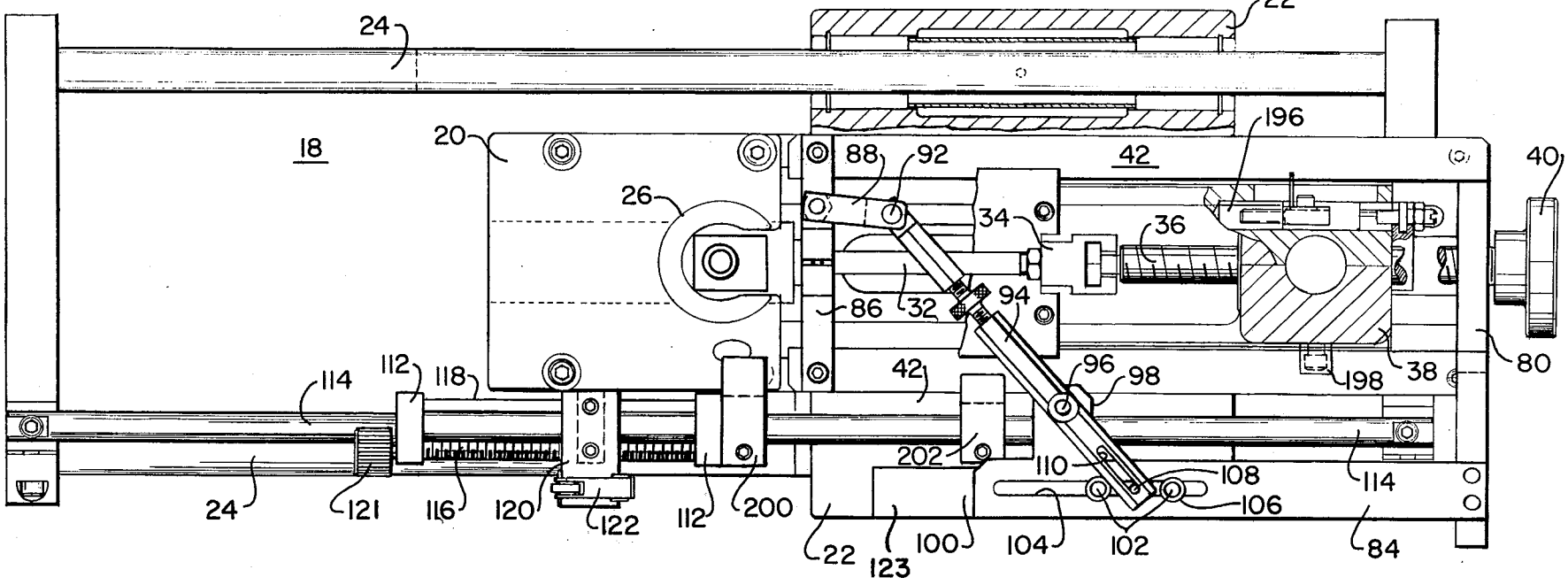
FIG. 8 is a partially sectional top plan of the mechanism shown in FIG. 7.

Referring to FIGS. 6–8, a finger 194 is mounted to the end of the slide 20 remote from the stand 38 and a finger 196 is mounted to the stand 38. The fingers 194 and 196 are located on opposite sides of the shaft 138 and are in intersecting relationship with the arm 170 during movement of the slide 20 with respect to the turntable 18 in the manner described below.

As shown in FIG. 8, a projection 198 mounted to the stand 38 is in intersecting relationship with a lug 200 that is mounted to the rod 114 and the lowermost end of the bracket 86, as seen in FIG. 8, is in intersecting relationship with a lug 202 that is also mounted to the rod 114.

Figure 5:
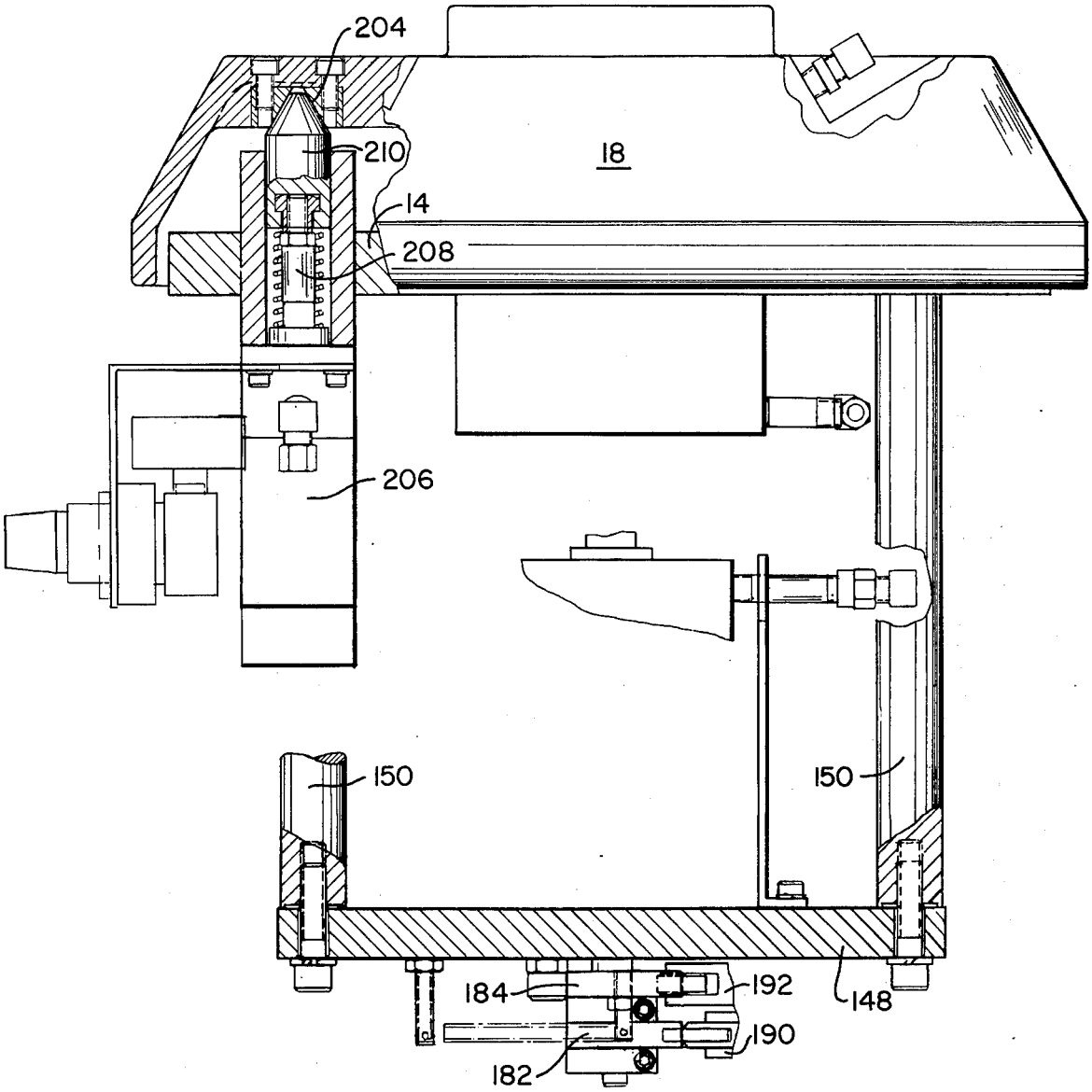
FIG. 5 is a partially sectional elevation showing a mechanism for locking the table against rotation.

Referring to FIG. 5, a pair of recesses 204 are located 180 degrees apart in the bottom of the turntable 18. An air actuated motor 206, having an upwardly extending piston rod 208, is mounted to the base 14. A plunger 210 is mounted to the top of the piston rod 208 and is in registry with whichever of the recesses 204 is located above the plunger 210 pursuant to the rotation of the turntable 18 in the manner described below.

Figure 11:
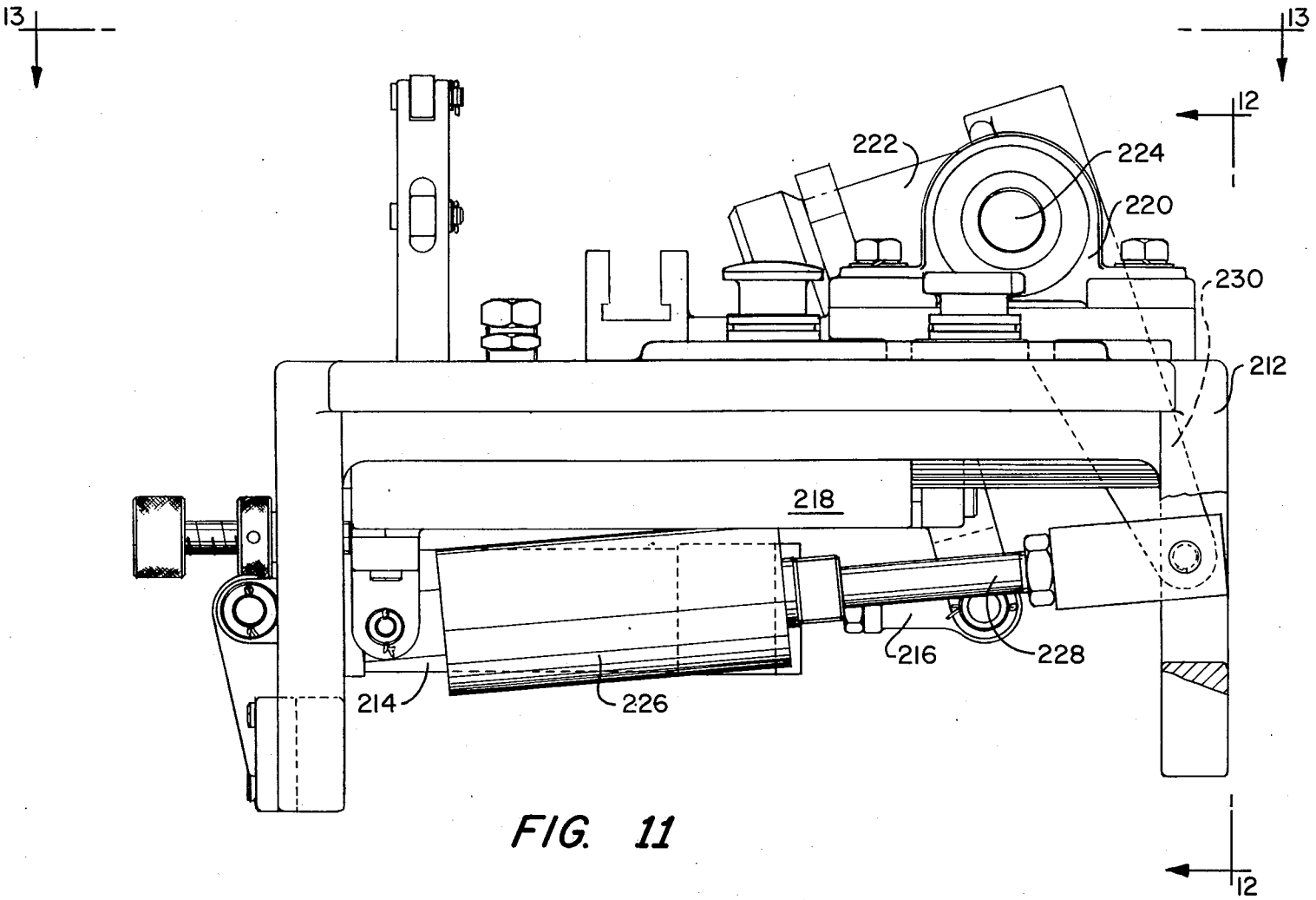
FIG. 11 is a side elevation of a construction for effecting heightwise and forward-rearward movement of the roughing tool.
Figure 12:
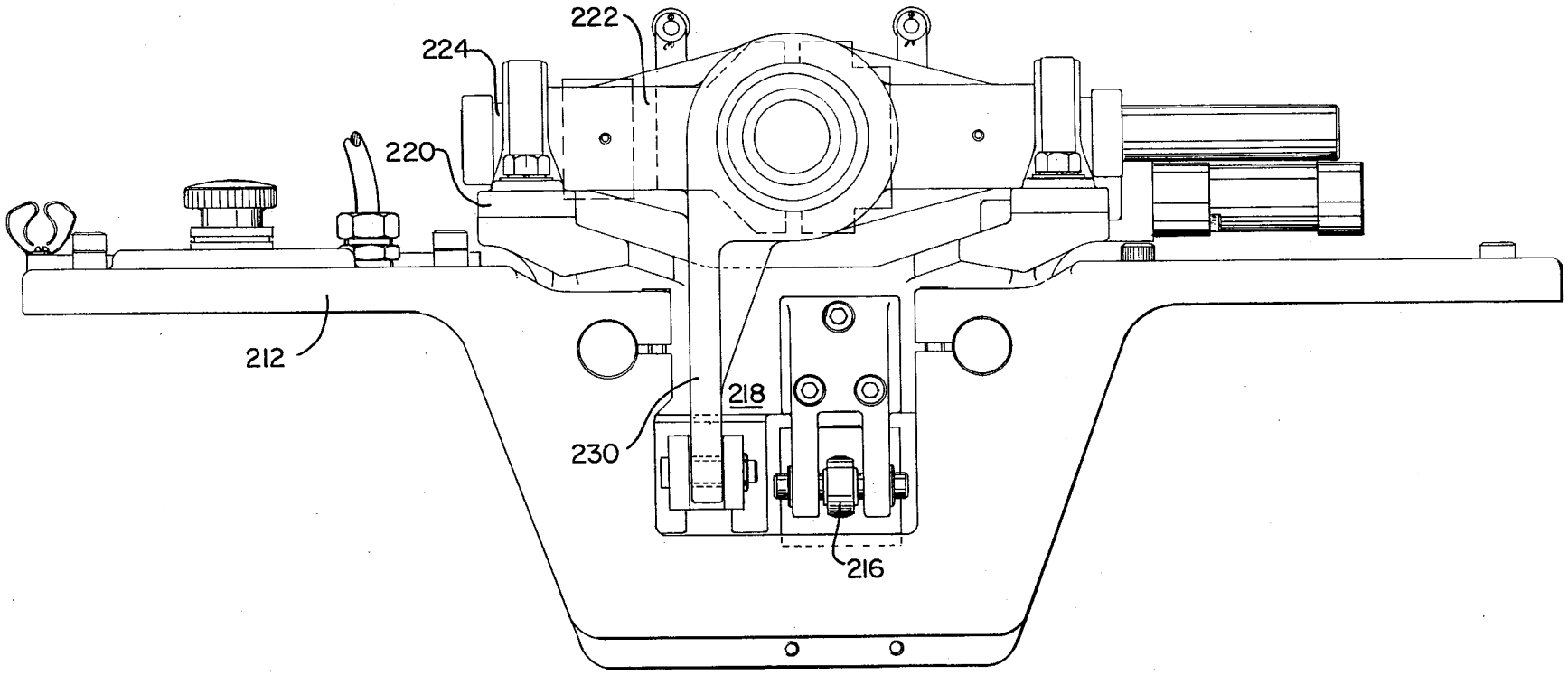
FIGS. 12 and 13 are view respectively taken along the lines 12—12 and 13—13 of FIG. 11.
Figure 13:
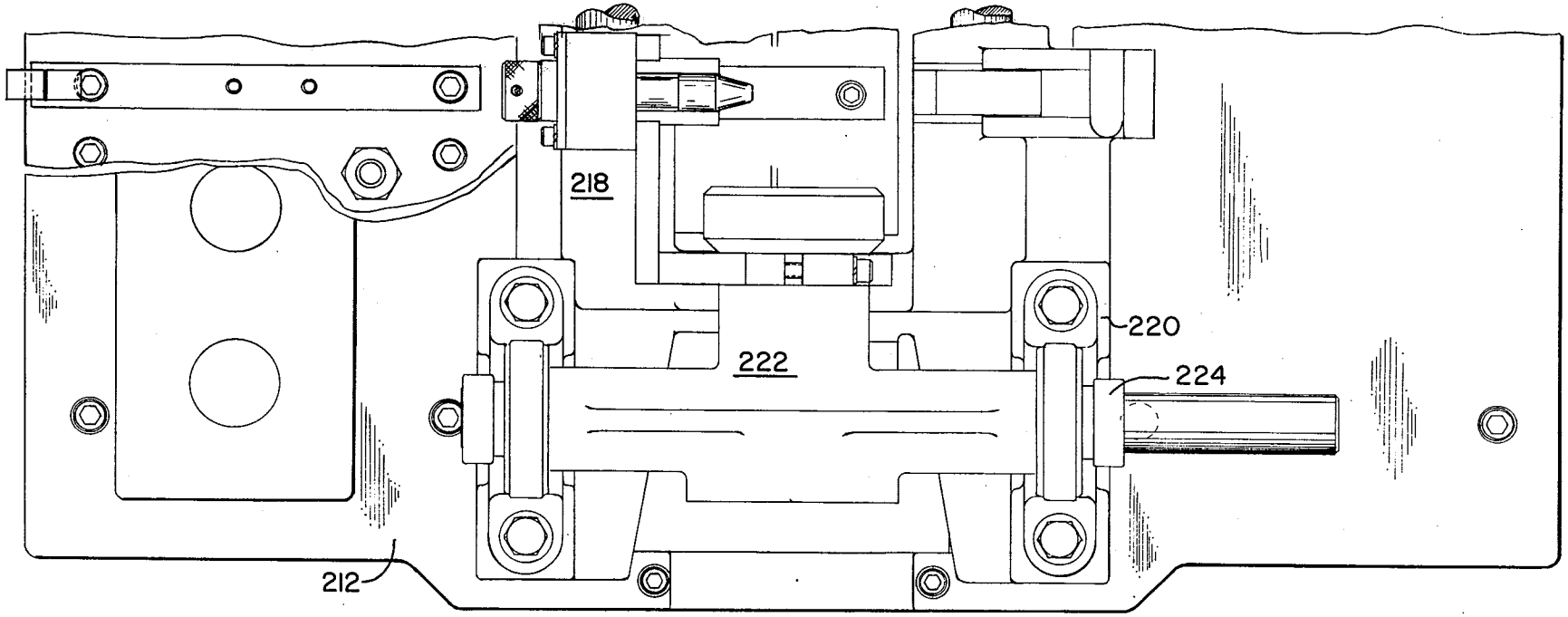

Referring to FIGS. 11–13, the tool section 12 includes a frame 212 in which an hydraulically operated motor 214 is mounted. The piston rod 216 of the motor 214 is connected to a slide 218 that is mounted for forward-rearward movement in the frame 212. Trunnions 220 on the slide 218 pivotally mount a yoke 222 for heightwise swinging movement about the horizontal axis of spindles 224 that are rigid with the yoke 222 and that are rotatably mounted in the trunnions 220. An air operated motor 226 is pivotally mounted on the slide 218 and has a piston rod 228 that is pivotally connected to a dependent arm 230 of the yoke 222 to thereby enable the motor 226 to effect heightwise swinging movement of the yoke 222 about the axis of the spindles 224.

Figure 14:
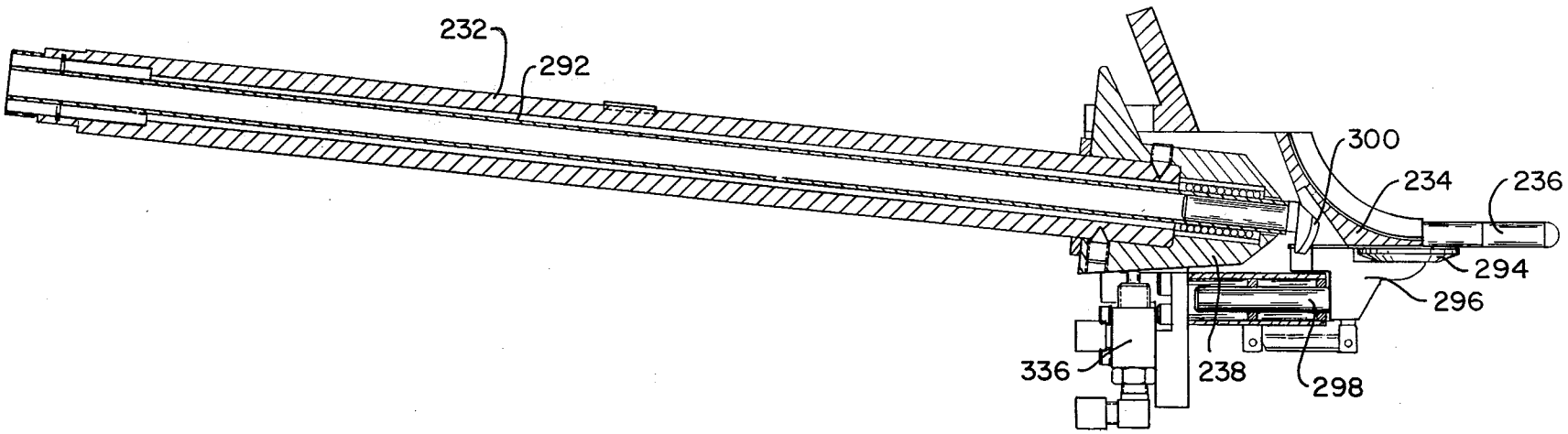
FIGS. 14 and 15 are side views of tines and a sensing member that engage the shoe assembly in connection with the aforementioned operating means.
Figure 15:
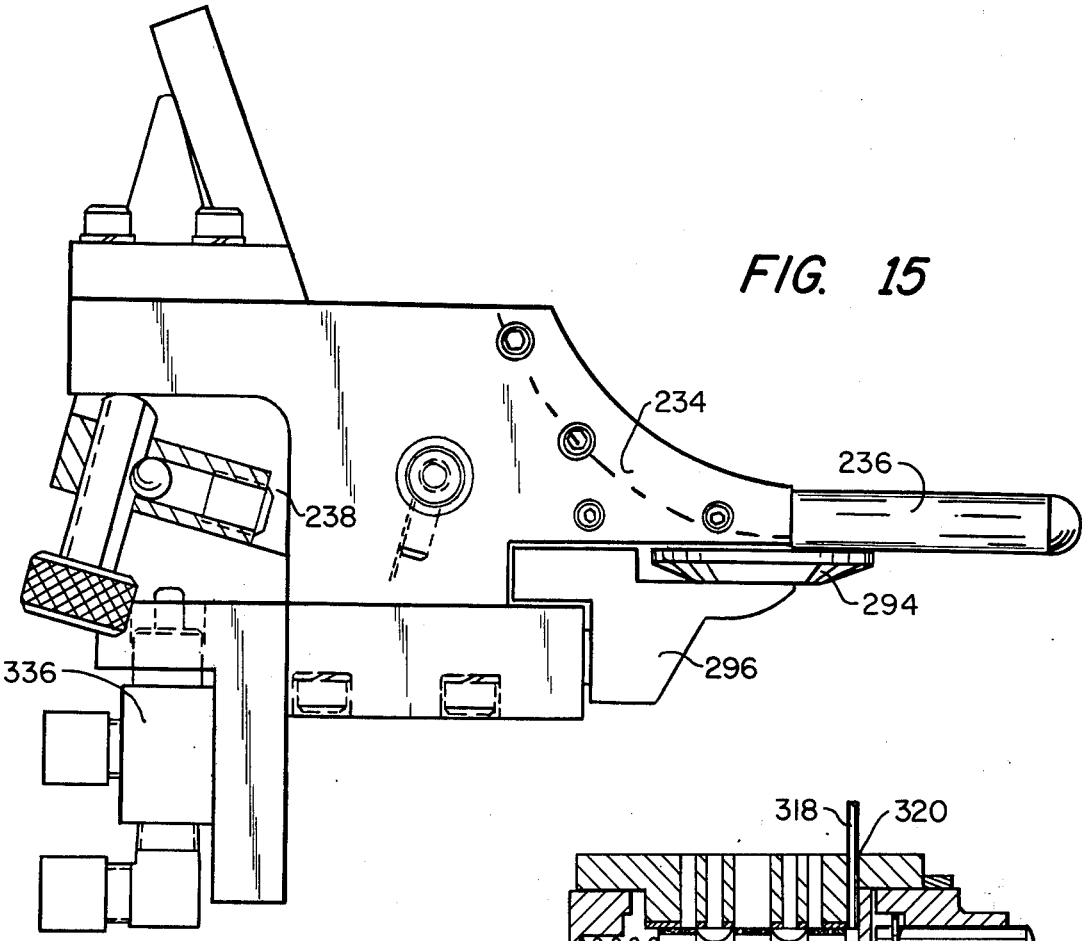

Referring to FIGS. 2 and 3, a hollow shaft 232 extends forwardly and rearwardly through the yoke 222 and is so mounted in the yoke 222 that it is rotatable about its longitudinal axis but is fixed against forward-rearward movement in the yoke 222. As shown in FIGS. 14 and 15, a fork 234, having a pair of forwardly extending tines 236 (see also FIG. 1), is pivoted to a fork mount 238 that is anchored to the front of the shaft 232.

Figure 16:
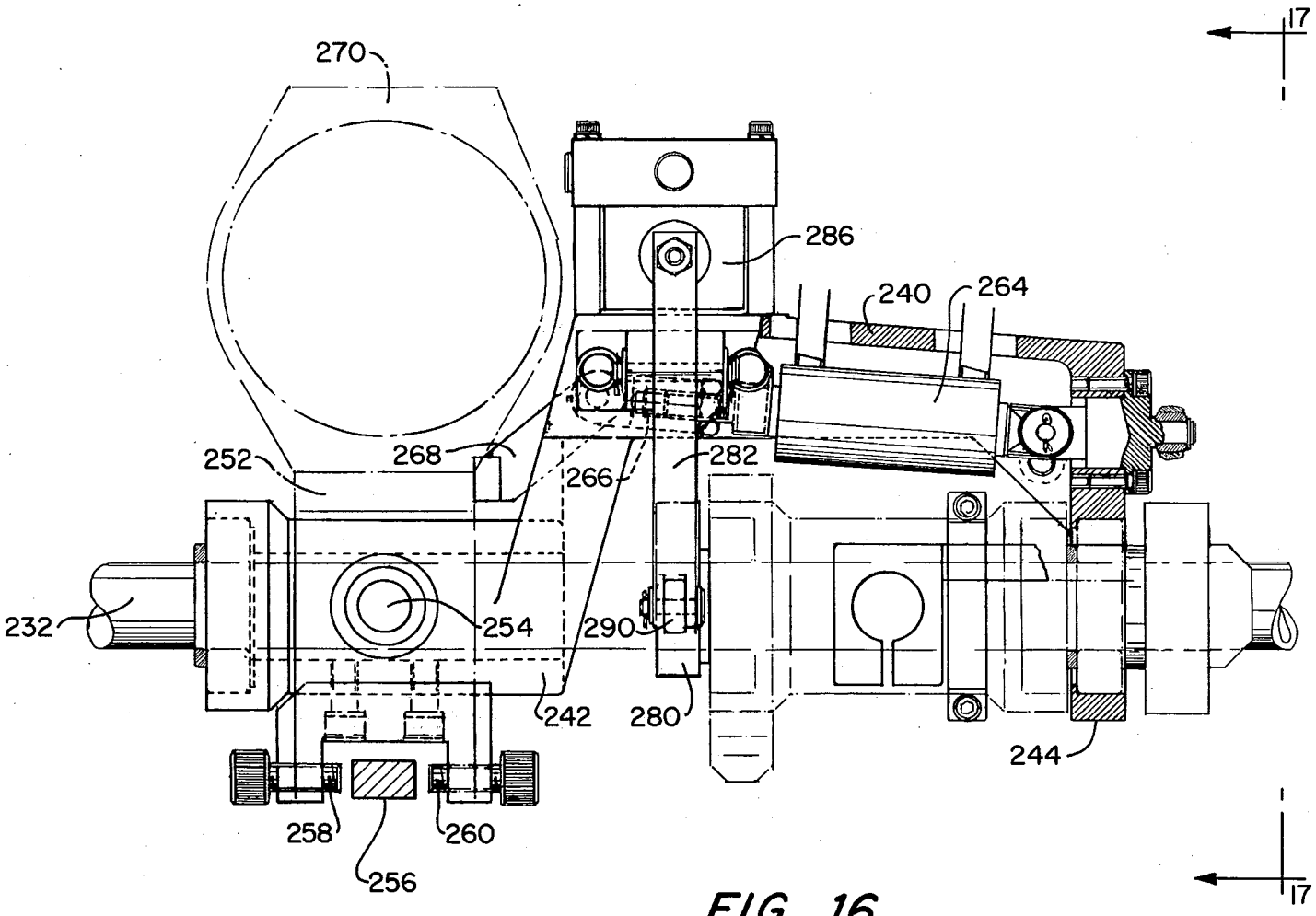
FIG. 16 is a view of a part of the machine that incorporates the aforementioned drive means.
Figure 17:
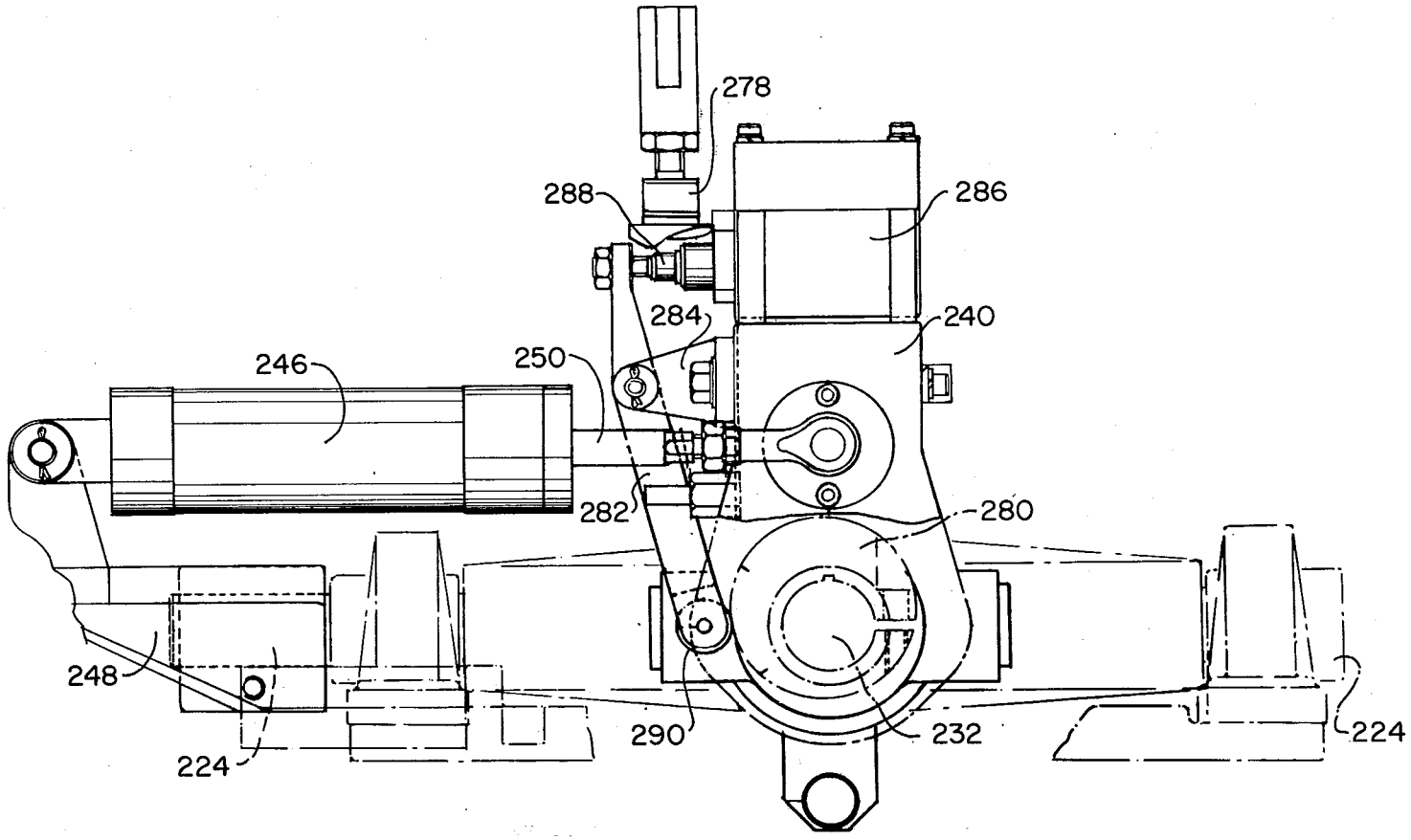
FIG. 17 is a view taken along the line 17—17 of FIG. 16.
Figure 18:
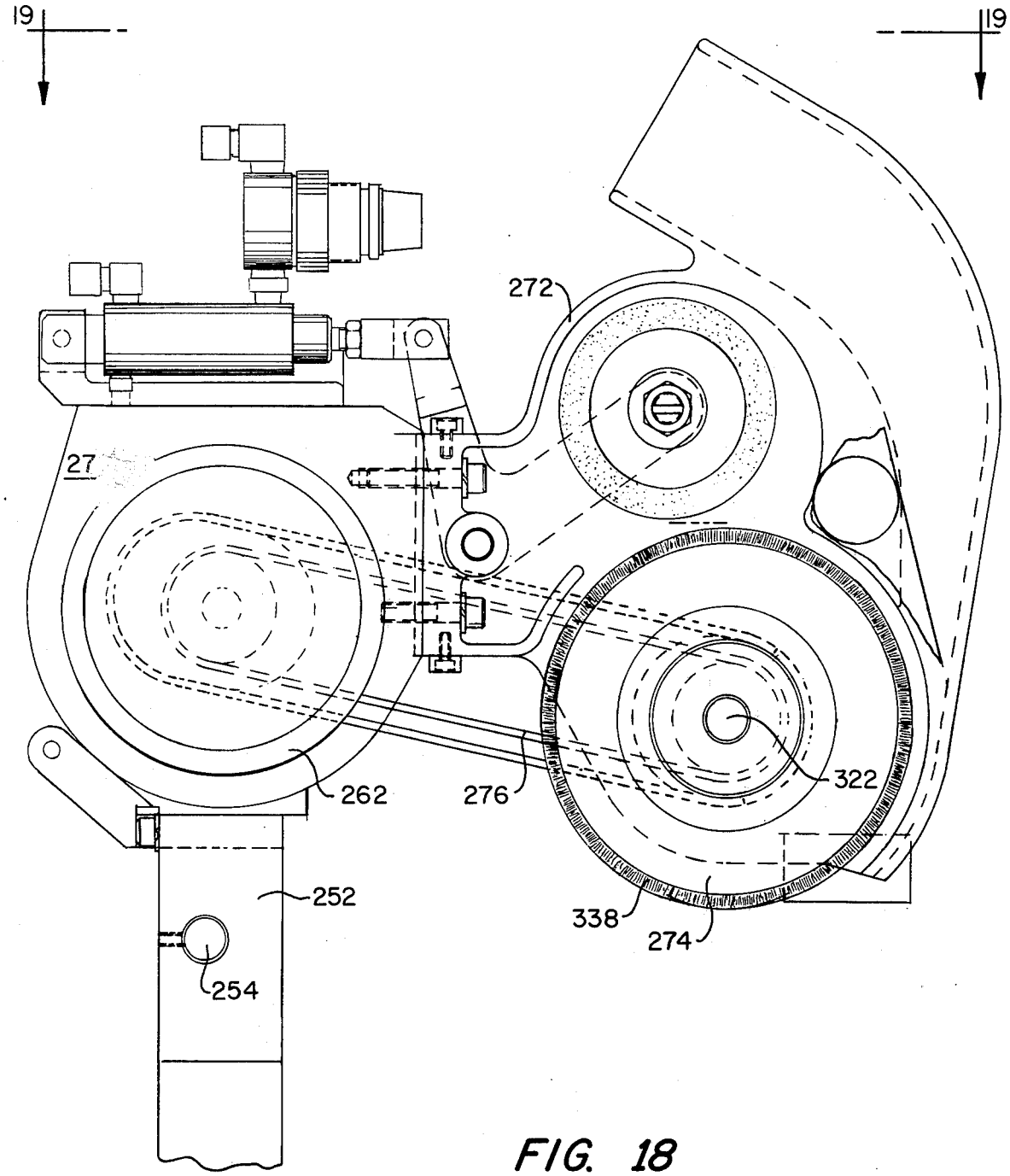
FIG. 18 is a view of a part of the machine that incorporates the roughing tool and a drive for rotating the roughing tool.
Figure 19:
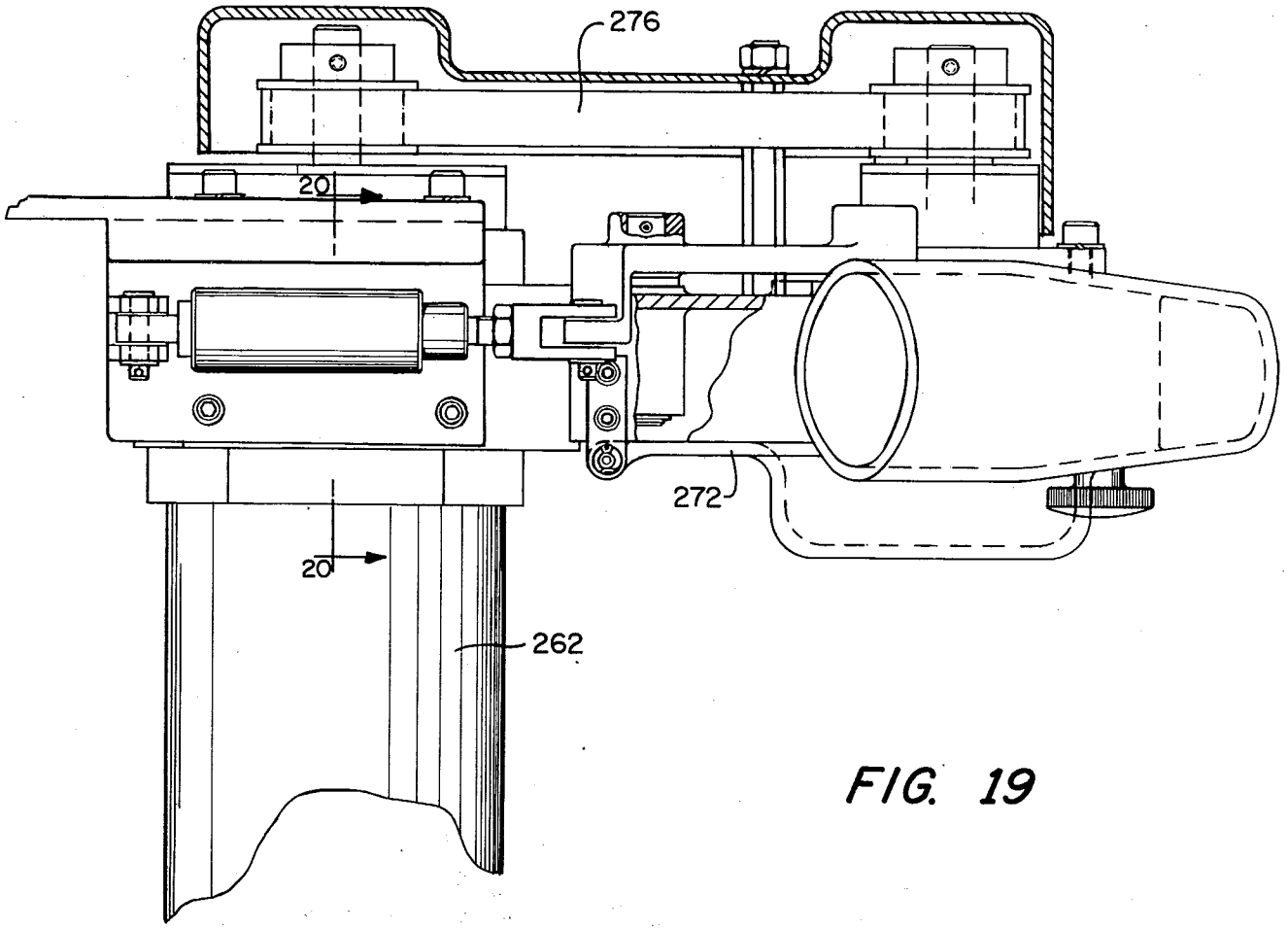
FIG. 19 is a view taken along the line 19—19 of FIG. 18.
Figure 20:
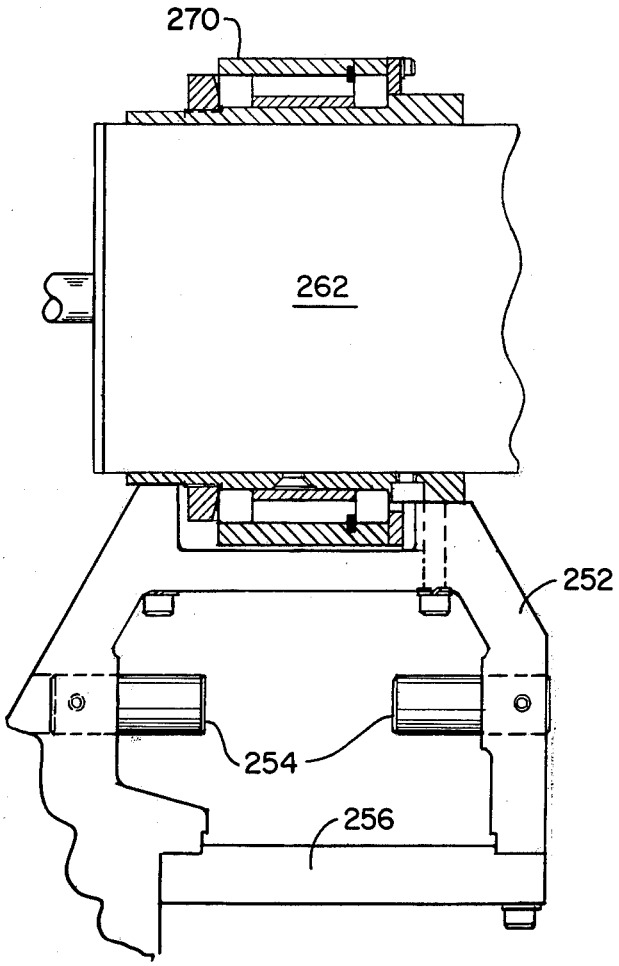
FIG. 20 is a section taken along the line 20—20 of FIG. 19.

Referring to FIGS. 16 and 17, a housing 240 is rotatably mounted for swinging movement about the longituding axis of the shaft 232 by means of a front trunnion 242 and a back trunnion 244 on the housing 240, the trunnions being so mounted to the shaft 232 as to be locked against forward-rearward movement on the shaft. An hydraulically operated motor 246 is secured to a flange 248 that is rigid with one of the spindles 224. The piston rod 250 of the motor 246 is pivoted to the back of the housing 240 whereby the motor 246 may effect lateral swinging of the housing about the axis of the shaft 232.

Referring to FIGS. 16 and 18–20, a mount 252 is pivoted by pins 254 to the front trunnion 242 of the housing 240 for forward-rearward movement about the axis of the pins 254. A bar 256 on the mount 252 is located between a front stop 258 and a back stop 260 that are mounted to the front trunnion 242. An electric motor 262 is rigidly secured to the mount 252 above the front trunnion 242. An air operated motor 264, mounted to the back trunnion 244, has a forwardly directed piston rod 266 that is pivoted to a bracket 268 secured to the mount 252 whereby the motor 264 can effect forward-rearward movement of the mount 252 about the axis of the pins 254.

A housing 270 is rotatably mounted to the motor 262 for swinging movement about the axis of the motor 262. A tool holder 272, mounted to and extending forwardly of the housing 270, rotatably mounts a roughing tool in the form of a wire brush 274. The motor 262 and the brush 274 are driveingly connected by a belt 276 so as to enable the motor 262 to rotate the brush 274. As shown in FIG. 1, the brush 274 is located proximate to and between the fork tines 236.

A counterweight assembly 276 (FIGS 2 and 3) is affixed to the housing 270. An air operated motor 278 is interposed between the housing 240 and the counterweight assembly and is mounted to the housing 240 with the upwardly projecting piston rod 279 of this motor being connected to the counterweight assembly so that the motor 278 may effect heightwise movement of the brush 274 about the axis of the motor 262.

Referring to FIGS. 16 and 17, a cam 280 is affixed to the shaft 232 between the trunnions 242 and 244. A lever 282 is pivoted between its ends to a flange 284 that is secured to the housing 240. A valve 286, mounted to the housing 240, has a spool 288 that is movably mounted in the body of the valve for movement towards and away from the top of the lever 282. The valve spool 288 is yieldably urged against the top of the lever 282 by pressurized air entering the valve 286. A cam follower 290, mounted to the bottom of the lever 282, is urged into engagement with the periphery of the cam 280 by the valve spool 288 under the influence of the pressurized air entering the valve 286. The valve 286 and the motor 246 are so connected to each other and to a source of hydraulic fluid as to form a servo follow up mechanism that is so constructed, in a known manner, that relative motion of the valve spool 288 with respect to the body of the valve 286 causes a corresponding extent of motion in one direction or the other of the piston rod 250 with respect to the motor 246.

Figure 21:
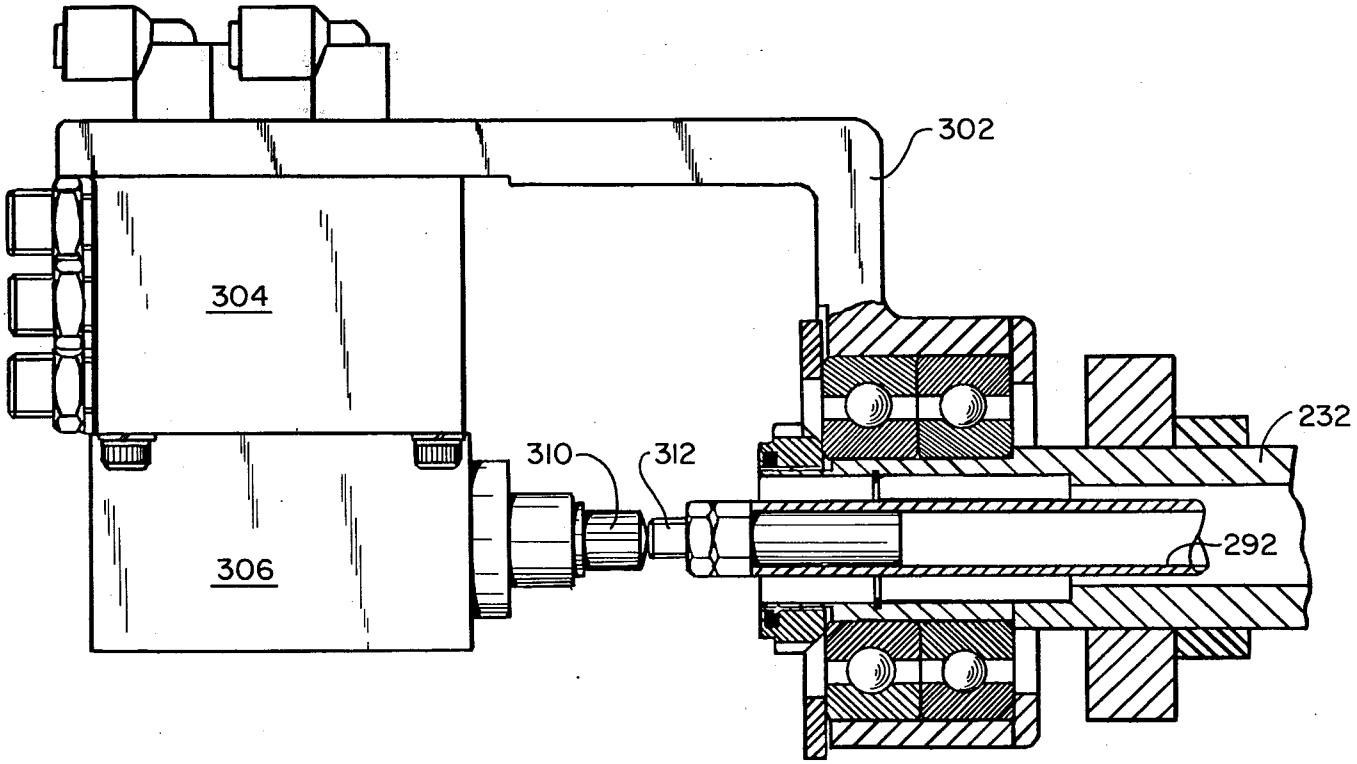
FIG. 21 is a partially sectional view of a control that is a part of the aforementioned operating means that effects forward-rearward movement of the roughing tool to enable the roughing tool to follow the contour of the side of the shoe assembly.

Referring to FIGS. 14 and 21, a bar 292 is mounted within the shaft 232 for forward-rearward movement. A sensing member 294 is mounted to a housing 296 and is located beneath the folk tines 236. Rods 298, that are secured to the housing 296 and are mounted for forward-rearward movement in the fork 234, act to mount the sensing member 294 for forward-rearward movement in the fork 234. A head 300, that is mounted to the front of the bar 292, is in intersecting relationship with the back of the housing 296 to thereby limit the extent of rearward movement of the sensing member 294 in the fork 232.

Figure 22:
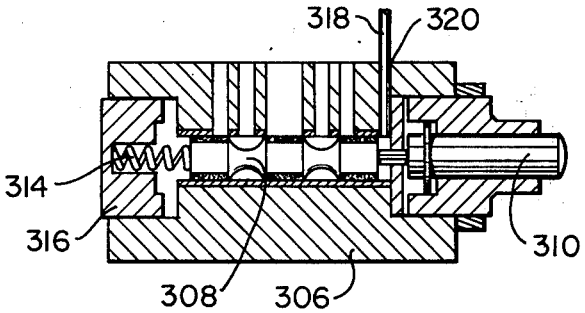
FIG. 22 is a section of a valve that forms a part of the control shown in FIG. 21.

Referring to FIGS. 21 and 22, a flange 302 is mounted to the back of the shaft 232, a manifold 304 is mounted to the flange 302, and a valve 306 is rigidly secured to the manifold 304. The valve 306 has a valve spool 308 that is reciprocably mounted in the valve 306 for forward-rearward movement. The front of the valve spool 308 is in alignment with a plunger 310 that is mounted for forward-rearward movement in the valve 306. The plunger 310 is in alignment with a pin 312 that is secured to the back of the bar 292. The valve spool 308 is yieldably urged forwardly in the valve 306 by a compression spring 314 that is interposed between a cap 316 at the back of the valve 306 and the back of the valve spool 308.

The valve 306 and the motor 214 are so connected to each other and to a source of hydraulic fluid under pressure as to form a servo follow up mechanism so constituted, in a known manner, that forward-rearward movement in one direction or the other of the valve spool 308 with respect to the median position in the valve 306 shown in FIG. 22 causes corresponding motion in one direction or the other of the piston rod 216 with respect to the motor 214.

In the idle condition of the machine: the piston rod 32 is projected out of the motor 30 to place the stand 38 and the parts carried thereby, including the toe pad 50, the toe stop 66 and the finger 196 and the projection 198, relatively remote from the post 26 and the last pin 28; the piston rod 48 is retracted into the cylinder 46 to place the toe pad 50 in a lower position; the piston rod 55 is retracted into the cylinder 54 so that the brake pad 56 is spaced upwardly of the surface 58 of the slide 20; the piston rod 62 is projected out of the motor 60 to place the toe stop 66 in a raised position; the slide 20 is at one end of the turntable 18 with the bracket 86 bearing against the lug 202, with the finger 194 in engagement with the arm 170 and with the cam 172 swung against the force of the spring 174 so that the valve 180 is open; the last pin is in substantial alignment with the axis of rotation of the turntable 18, and the last pin 28 is in substantial forward-rearward alignment with the brush 274; the cam 123 is spaced from and out of engagement with the valve 122 and the valve 122 is open; the shaft 152 is rotating; the clutches 132, 140 and 146 are uncoupled so that the sprocket 160 is being rotated about the stationary shaft 128 by the sprocket 156, the sprocket 166 is being rotated about the stationary shaft 138 by the sprocket 162, and the shaft 144 is stationary; the cams 182 and 184 are in the FIG. 6 position wherein the cam lobe 186 is engaging the valve 190 and the cam lobe 188 is disengaged from the valve 192; the piston rod 208 is projected out of the motor 206 with the plunger 210 inserted inot one of the recesses 204 of the turntable 18 to lock the turntable against rotation; pressurized air is entering the valve 306 through a line 318 (FIG 22) and a port 320 to thereby move the valve spool 308 rearwardly against the force of the spring 314 to thus cause the servo follow up mechanism interconnecting the valve 306 and the motor 214 to retract the piston rod 216 into the motor 214 and thus place the slide 218, together with the fork tines 236, the roughing brush 274 and the sensing member 294 in a rearward position; the piston rod 228 is projected out of the motor 226 to thus place the fork tines 236, the roughing brush 274 and the sensing member 294 in an upper positon; pressurized air is entering the body of the valve 286 to yieldably urge the valve spool 288 leftwardly (FIG. 17) against the top of the lever 282 while the cam 280 is causing the lever 282 to push the valve spool 288 to a median position in the body of the valve 286 to thereby cause the servo follow up mechanism connecting the valve 286 and the motor 246 to maintain the piston rod 250 in a median position in the motor 246 so that the fork tines 236 are in a substantially horizontal plane and the axis of rotation 322 (FIG. 18) of the brush 274 is in a substantially horizontal plane; the electric motor 262 is operative to rotate the brush 274; the piston rod 266 is projected out of the motor 264 to thereby swing the mount 252, together with the brush 274, forwardly about the axis of the pins 254 to a position wherein the bar 256 engages the back 260 in which position the brush 274 is in a relatively forward position with respect to the sensing member 294; and the piston rod 279 is retracted into the motor 278 to thus position the brush 274 in a relatively elevated position with respect to the fork tines 236.

Figure 23:
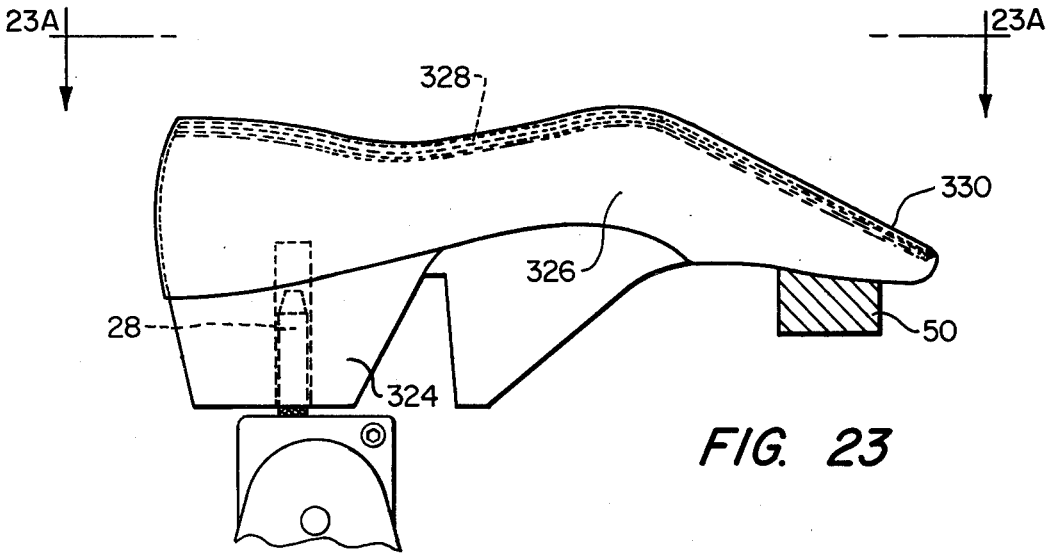
FIG. 23 is a side elevation of a shoe mounted in the machine.
Figure 23A:
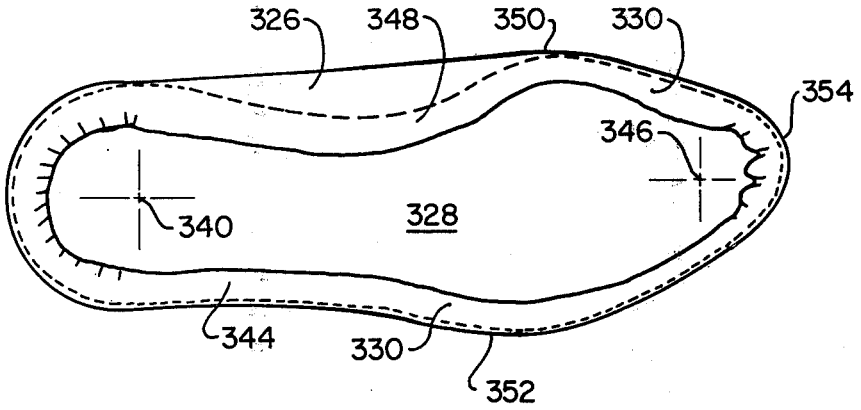
FIG. 23A is a view taken along the line 23A—23A of FIG. 23.

FIGS. 23 and 23A show a shoe assembly that comprises a last 324 having an upper 326 mounted thereon and an insole 328 mounted on its bottom. The upper 326 has been lasted so that the upper margin 330 lies against and is secured to the insole and extends inwardly of the periphery of the insloe and of the last bottom.

The shoe assembly is mounted by the operator bottom-up on the last pin 28, with the last pin entering the conventional thimble hole in the top of the heel portion of the last, in such a manner that the toe end of the shoe assembly faces the stand 38. The operator then depresses the shoe assembly to lower a stem 332 (FIG. 7) and thus operate a valve 334. Operation of the valve 334 so actuates the motor 30 as to cause the piston rod 36 to be retracted into the motor 30 so as to move the stand 38, together with the toe pad 50, the toe stop 66, the finger 196 and the projection 198, towards the pest 26 under the yieldable force of pressurized air until the toe stop 66 engages the toe end of the shoe assembly. During this movement of the stand 38, the linkage formed by members 88,92,94,96,98,102,104,106,108 and 110 enables the beam 100 and the cam 123 to move in the same direction as the stand 38 towards the valve 122 at a faster speed than the speed of movement of the stand 38 for reasons that will be explained below. When the stand 38 has terminated it movement, the cam 123 is still spaced from the valve 122. The engagement of the toe stop 66 with the toe end of the shoe assembly causes the toe stop 66 and the lug 74 to swing clockwise (FIG. 7) about the axis of the pin 68 to thus cause the cam surface 78 to shift the valve 76. The shifting of the valve 76 actuates the motors 44, 52 and 60 so that the motor 44 raises the toe pad 50, the motor 52 lowers the brake pad 56 to press it against the surface 58 of the slide 20 and the motor 60 lowers the stop 66.

The lowering of the toe stop 66 removes it from the periphery of the toe end of the shoe assembly so that it will not interfere with the roughing operation described below. The pressing of the brake pad 56 against the surface 58 locks the stand 38 in the position in the slide 20 it had assumed when the toe stop 66 engaged the toe end of the shoe assembly. The raising of the toe pad 50 under the yieldable force of pressurized air enables it to engage the forepart of the shoe assembly and tilt it about the last pin 28 until the last pin engages the perphery of the thimble hole in the last 324, thereby locking the shoe assembly to the slide 20 for the below described roughing operation.

The machine incorporates a construction similar to that shown in patent no. 3,843,985 that enables the motors 44,52 and 60 to remain in actuated condtition when the turntable 18 is rotated as described below.

After the shoe assembly has been locked to the slide 20, the motor 226 is so actuated under the force of pressurized air as to retract the piston rod 228 into this motor and thus lower the shaft 232 to thereby lower the fork tines 236, the roughing tool 274 and the sensing member 294 about the axis of the spindles 224 until the fork tines 236 engage the upper margin 330 in one of its breast line regions (FIGS. 24 and 24A), the shoe assembly being so located that the fork tines will intersect its bottom during their descent and the sensing member 294 will be located outwardly of the shoe assembly when the fork tines engage the shoe assembly. In response to the engagement of the fork tines 236 with the upper margin 330, a valve 336 (FIGS. 14 and 15) is shifted in the manner disclosed in application Ser. No. 546,223 filed Feb. 3, 1975. The shifting of the valve 336 causes the flow of pressurized air in the line 318 and the port 320 to be shut off thereby enabling the spring 314 to shift the valve spool 308, together with the plunger 310, the pin 312, the bar 292 and the sensing member 294 forwardly. This valve spool shifting actuates the motor 214, by means of the servo follow up mechanism interconnecting the valve 306 and the motor 214, to project the piston rod 216 forwardly to thus move the slide 218, together with the fork tines 236, the roughing tool 274 and the sensing member 294, forwardly. This forward movement is terminated when the sensing member 294 engages the side of the shoe assembly and then moves rearwardly in the fork 234 to thereby move the bar 292, the pin 312, the plunger 310 and the valve spool 308 rearwardly, the valve spool 308 moving rearwardly against the force of the spring 314 until the valve spool arrives in the median position shown in FIG. 22 in the valve 306. The arrival of the valve spool 308 in the median position enables the servo follow up mechanism interconnecting the valve 306 and the motor 214 to cause the motor 214 to terminate forward movement of the piston rod 216.

Figure 24:
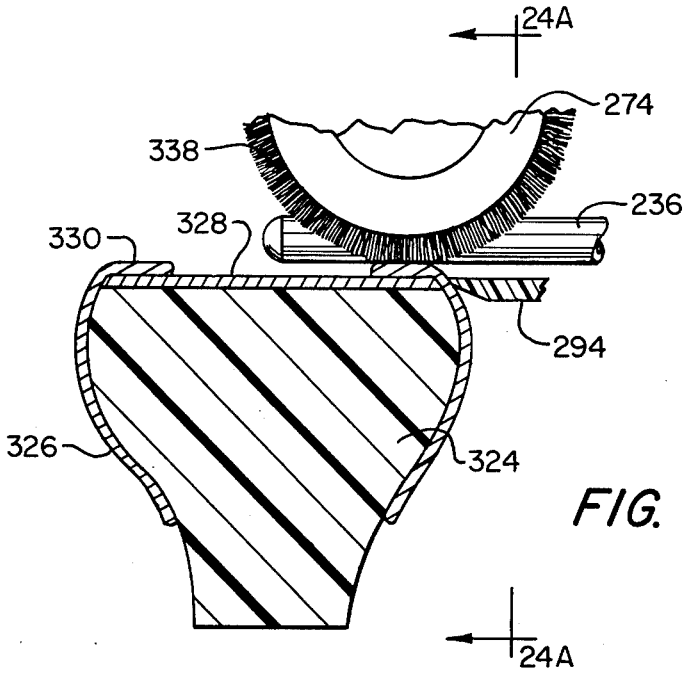
FIG. 24 is a section showing the shoe assembly and the shoe assembly engaging parts of the machine at the beginning of a roughing operation.
Figure 24A:
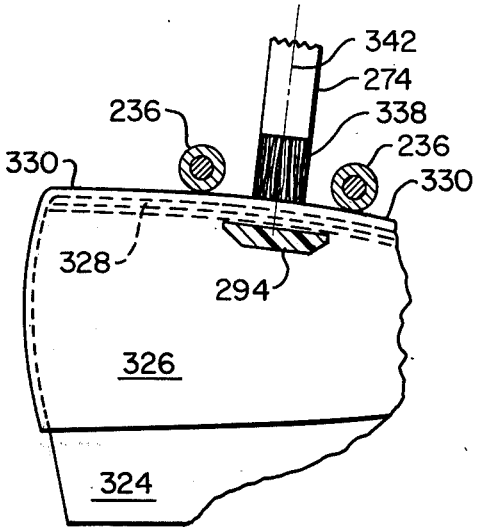
FIG. 24A is a view taken along the line 24A—24A of FIG. 24.

The shifting of the valve 366, after a time delay sufficient to enable the sensing member 294 to engage the side of the shoe assembly, also causes the motor 278 to project its piston rod 279 upwardly to thereby swing the roughing tool 274 downwardly about the axis of the motor 262 until radially projecting bristles 338 on the brush 274 engage the upper margin 330 between the fork tines 236, as indicated in FIGS. 24 and 24A.

The shifting of the valve 336, after the time delay referred to in the preceding paragraph, also actuates the motor 206 to move the plunger 210 away from the recess 204 with which it had been in engagement to unlock the turntable 18 for rotation and actuates the clutch 140 to couple the rotating spocket 166 to the shaft 138 to thereby rotate the shaft 138. The rotation of the shaft 138, by way of the gears 134 and 136, effects rotation of the turntable 18 about the axis of the sleeve 16 to thus rotate the slide 20 and the shoe assembly about a center that is substantially in alignment with the last pin 28 and that lies approximately at the center of curvature, indicated by number 340 in FIG. 23A, of the heel portion of the bottom of the shoe assembly.

From the foregoing, it can be seen that the engagement of the fork tines 236 causes a lowering of the rotating brush 274 into engagement with the upper margin 330 and a movement of the heel portion of the upper margin past the rotating brush. This arrangement enables the bristles 338 of the rotating brush 274 to abrade or rough the upper margin 330 as it is moving past the brush.

During the movement of the heel portion of the upper margin past the rotating brush 274, as well as the movement of the other portions of the upper margin past the rotating brush as described below, the brush must move upwardly or downwardly in accordance with the elevation of the upper margin being roughed and must move forwardly and rearwardly so as to be positioned the desired distance inwardly of the outer periphery of the upper margin being roughed. In addition, the central plane of the brush 274 which is at right angles to its axis of rotation, indicated by the chain line 342 in FIG. 24A, should be tilted during the movement of the portions of the upper margin being roughed past the roughing brush 274 so as to be at right angles to the plane of the portion of the upper margin 330 being roughed.

The upward and downward movement of the brush 274 during the movement of the upper margin past the brush is accomplished by virture of the fact that the brush is mounted to partake of the swinging movement of the yoke 222 and is thus resiliently urged downwardly by the air operated motor 226.

The forward and rearward movements of the brush 274 during the movement of the upper margin past the brush is accomplished by the sensing member 294 which is being resiliently urged forwardly against the side of the shoe assembly by the spring 314. The servo follow up mechanism connecting the motor 214 and the valve 306 is so constituted that the piston rod 216 is stationary to maintain the brush stationary in forward-rearward directions when the valve spool 308 is in a median position in the valve 306. A forward movement of the sensing member 294 by a portion of the side of the shoe assembly being displaced from the sensing member causes the valve spool 308 to move forwardly in the valve 306 to thereby cause the associated servo follow up mechanism to so operate the motor 214 as to move the piston rod 216 forwardly and thus move the brush 274 and the sensing member 294 forwardly until the sensing member again engages the side of the shoe assembly and thereby causes the bar 292 to move the valve spool 308 into its median position in the valve 306. A rearward movement of the sensing member 294 by a rearward pushing of the sensing member by a portion of the side of the shoe assembly causes the bar 292 to move rearwardly to push the valve spool 308 rearwardly in the valve 306 to thereby cause the associated servo follow up mechanism to so operate the motor 214 as to move the piston rod 216 rearwardly and thus move the brush 274 and the sensing member 294 rearwardly until the side of the shoe assembly stops pushing the sensing member rearwardly so that the valve spool 308 regains its median position in the valve 306.

The tilting of the central plane 342 of the brush 274 is accomplished by the mounting of the fork tines 236, together with the housing 240, for rotation about the axis of the shaft 232. During the movement of the upper margin 330 past the fork tines 236 that are being yieldably urged downwardly against the upper margin, the tines swing about the axis of the shaft 232 so that a plane connecting the bottoms of the tines is parallel to the plane of the upper margin engaged by the tines. This causes the cam 280 to swing one way or the other and thus, through the lever 282, effect movement of the valve spool 288 one way or the other from a median position in the body of the valve 286. A movement of the valve spool 288 in one direction or the other from its median position in the body of the valve 286 enables the servo follow up mechanism interconnecting the valve 286 and the motor 246 to cause the motor 246 to move the piston rod 250 in a direction to swing the housing 240 one way or the other until the valve spool 288 is again in its median position in the body of the valve 286. The swinging of the housing 240 in a particular direction cause the brush 274 to be swung in a corresponding direction until its central plane 342 lies in a plane at right angles to the plane of the bottoms of the fork tine 236.

As the shoe assembly rotates about the axis 340 the finger 194 becomes disengaged from the arm 170, thus enabling the spring 174 to cause the cam 172 to close the valve 180, and the cam lobe 188 engages and closes the valve 192. When the shaft 138 has rotated 180 degrees from its starting position shown in FIG. 6, the cam lobe 186 is disengaged from the valve 190 thereby permitting this valve to open. The opening of the valve 190 actuates the pneumatic clutch 146 so as to couple the shaft 144 for rotation in unison with the shaft 152, deactuates the clutch 140 to thereby terminate the rotation of the shaft 138 and thus terminate the rotation of the turntable 18, and the motor 206 is actuated to bring the plunger 210 into engagement with a recess 204 to thus lock the turntable 18 against rotation. From the foregoing, it can be seen that, after the turntable 18 has rotated 180 degrees to enable the heel portion of the upper margin 330 from one breast line portion to the other breast line portion to be roughed by the tool 274, the turntable 18, together with the shoe assembly, ceases its rotation and the shaft 144 is caused to rotate. The rotation of the shaft 144, by means of the gears 130, 142, causes the shaft 128 to rotate to thus rotate the gear 126 in a direction to linearly move the rack 124, together with the slide 20 and the shoe assembly, with respect to the stationary turntable 18 lengthwise past the brush 274 so that the brush 274 engages a first side portion 344 (FIG. 23A) of the upper margin 330 as the shoe assembly moves in a heel to toe direction past the brush 274 to thereby enable the brush to rough the first side portion 344 of the upper margin. This lengthwise movement of the shoe assembly in a heel to toe direction past the brush 274 continues until the finger 196 engages the arm 170 and the projection 198 engages the lug 200. The arm 170 at this time is in intersecting relationship with the finger 196 due to the aforementioned disengagement of the finger 194 from the arm 170 during the rotation of the shoe assembly about the axis 340.

The aforementioned movement of the finger 1 and the porjection 198 towards post 26 by the motor 30 terminated when the toe stop 66 engaged the toe end of the shoe assembly and placed the finger 196 and the projection 198 in a position wherein the aproximate center of curvature of the toe portion of the shoe assembly, indicated by number 346 in FIG. 23A, is in registry with the axis of rotation of the turntable 18, formed by the axis of the sleeve 16, when the slide 20 completes its lengthwise movement on the statinary turntable 18 and the shoe assembly completes its movement in a heel to toe direction past the brush 274. The engagement of the arm 170 by the finger 196 causes the cam 172 to open the valve 180.

The opening of the valve 180 causes the motor 206 to move the plunger 210 away from the recess 204 it had engaged to unlock the turntable 18 for rotation. The opening of the valve 180 also deactuates the clutch 146 to terminate the lengthwise movement of the slide 20 and of the shoe assembly in the turntable 18 and actuates the clutch 140 to again cause rotation of the turntable 18, the turntable now rotating about the axis 346 so that the toe portion of the upper margin 330 is swung past the brush 274 and is roughed.

As the shoe assembly rotates about the axis 346, the finger 196 becomes disengaged from the arm 170, thus enabling the spring 174 to cause the cam 172 to close the valve 180, and the cam lobe 186 engages and closes the valve 190. When the shaft 138 has rotated 180 degrees from its starting position to swing the toe portion of the upper margin 330 through a 180 degree arc past the brush 274, the cam lobe 188 is disengaged from the valve 192 thereby permitting this valve to open. The opening of the valve 192 causes the clutch 140 to be deactuated and causes the motor 206 to move the plunger 210 into engagement with a recess 204 to thereby terminate the rotation of the turntable 18 and to lock the turntable against rotation.

The opening of the valve 192 also actuates the pneumatic clutch 132 to couple the rotating sprocket 160 to the shaft 128 to thereby rotate the shaft 128 and to cause the gear 126 to rotate in the opposite direction from which it was previously rotated in response to the actuation of the clutch 146. This rotation of the gear 126 moves the rack 124, together with the slide 20 and the shoe assembly, lengthwise past the brush 274 so that the brush 274 engages the second side portion 348 (FIG. 23A) of the upper margin 330 as the shoe assembly moves in a toe to heel direction past the brush 274 and the brush 274 thus roughs the second side portion 348 of the shoe assembly. The lengthwise movement of the shoe assembly in a toe to heel direction past the brush 274 continues until the finger 194 engages the arm 170 which is in intersecting relationship with the finger 194 due to the aforementioned disengagement of the finger 196 from the arm 170 during the rotation of the shoe assembly about the axis 346. The engagement of the arm 170 by the finger 194 causes the cam 172 to again open the valve 180.

This opening of the valve 180 causes the deactuation of the clutch 132 to terminate the toe to heel movement of the shoe assembly past the brush 274 and causes the machine parts to return to their idle positions and complete the machine cycle. The shoe assembly, with the roughed upper margin, is now removed from the machine.

Figure 25:
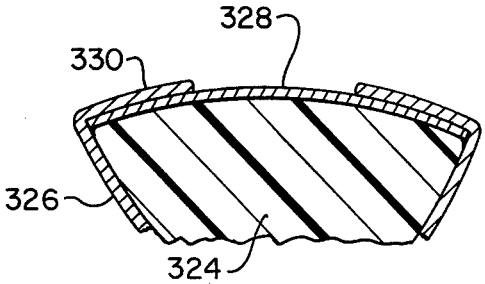
FIG. 25 is a section of the forepart portion of the shoe assembly.

As shown, somewhat exagerratedly, in FIG. 25, the bottom of the forepart of the shoe assembly, extending between the ball breaks 350 and 352 (FIG. 23A) at the widest part of the shoe assembly bottom and the toe end extremity 354, is somewhat rounded and upwardly convex while the bottom of the shoe assembly is relatively horizontal and flat in a cross-section taken from side of the shoe assembly in the non-forepart portion of the shoe assembly, as shown in FIG. 24. Therefore, in the forepart portion of the shoe assembly as shown in FIG. 24. Therefore, In the forepart portion of the shoe assembly the bottom of the shoe assembly slopes upwardly as it extends inwardly of the periphery of the bottom of the shoe assembly. At the beginning of the roughing operation the brush 274 had been placed in a relatively forward position with respect to the sensing finger 294 by the motor 264 due to the piston rod 266 being projected out of this motor so that the bristles 338 engage and rough the upper 330 a desired distance inwardly of the upper margin periphery. However, due to the inward and upward inclination of the upper margin 330 in the forepart portion of the shoe assembly, this relatively forward position of the brush 274 with respect to the sensing finger 294 would cause the bristles 338 to engage the upper margin further inwardly of the upper margin periphery than it does in the non-forepart portion of the shoe assembly. In order to overcome this difficulty, the brush 274 is moved rearwardly relative to the sensing member 294 by adjusting means during the movement of the forepart portion of the upper margin 330 past the roughing brush 274 in the manner described below.

The valve 122 and the motor 264 are so connected to each other and to a source of air under pressure that when the valve 122 is open the piston rod 266 is projected out of the motor 264 to position the brush 274 in a relatively forward position with respect to the sensing member 294, as in the idle condition of the machine. When the valve 122 is closed by the cam 123, as described below, the connections between the valve 122, the motor 264 and the source of air under pressure are such as to cause the motor 264 to retract the piston rod 266 to a position wherein the bar 256 engages the front stop 258 in which position the brush 274 is in a relatively rearward position with respect to the sensing member 294.

During the aforementioned heel to toe movement of the shoe assembly past the brush 274 to rough the side portion 344 of the upper margin 330 by the linear movement of the slide 20 with respect to the stationary turntable 18, the cam 123 engaged the valve 122 to close the valve 122. The machine parts are so dimensioned that the valve 122 was closed by the cam 123 when the upper margin in the region of the ball break 352 was being engaged and roughed by the brush 274. The valve 122 stayed closed during the remainder of the heel to toe movement of the shoe assembly, during the rotation of the turntable 18 about the axis 346 wherein the toe portion of the upper margin 330 was roughed by the brush 274, and during the early part of the toe to heel movement of the shoe assembly past the brush 274 to rough the side portion 348 of the upper margin by the linear movement of the slide 20 with respect to the stationary turntable 18. The machine parts are so dimensioned that the cam 123 became disengaged from the valve 122 to enable the valve 122 reopen when the upper margin in the region of the ball break 350 was being engaged and roughed by the brush 274. Therefore the cam 133 the valve 122 and the connections between the valve 122 and the motor 264 act as the aforementioned adjusting means to move the brush 274 rearwardly relative to the sensing finger 294 during the movement of the forepart portion of the upper margin 330 past the roughing brush 274.

In the idle position of the machine, the stand 38 is in an idle stand position and the cam 123 is in an idle cam position. Pursuant to the operation of the motor 30, the projection 198 and the cam 123 are each moved in a toe to heel direction with respect to the shoe assembly until these movements are terminated by the engagement of the toe stop 66 with the toe end of the shoe assembly at which time the stand 38 is in a stand working position and the cam 123 is in a cam working position. For a particular shoe assembly, the extent of the heel to toe and toe to heel linear movements of the shoe assembly past the brush 274 is equal to the distance in heel-toe directins between the projection 198 when the stand 38 is in its working position and the lug 200. For a particular shoe assembly, the extent of linear heel to toe movement of the shoe assembly past the brush 274 before the actuation of the brush adjusting means caused by the engagement of the valve 122 by the cam 123 is equal to the distance in heel-toe directions between the cam working position and the valve 122. For a particular shoe assembly, the extent of linear toe to heel movement of the shoe assmebly past the brush 274 after the deactuation of the brush adjusting means by the disengagement of the cam 123 from the valve 122 is also equal to the distance in heel-toe directions between the cam working position and the valve 122.

In changing the machine from operation on a first shoe assembly to a second shoe assembly having a different overall length than the first shoe assembly, the distance in heel-toe directions between the projection 198 in the working position of the stand 38 and the lug 200 is greater for the second shoe assembly than for the first shoe assembly, if the second shoe assembly has a greater overall length than the first shoe assembly, and this distance is less for the second shoe assembly than for the first shoe assembly, if the second shoe assembly is shorter than the first shoe assembly, by amounts that are equal to the increase or decrease in overall length of the second shoe assembly with respect to the first shoe assembly. Therefore, the extend of heel to toe and toe to heel liner movements of the second shoe assembly past brush 274 is increased or decreased relative to the corresponding movements of the first shoe assembly by an amount that is equal to the increase or decrease in length of the second shoe assembly with respect to the first shoe assembly.

The increase or decrease of the heel-toe length of the forepart portion of the second shoe assembly from the corresponding portion of the first shoe assembly is less than the increase or decrease of the overall length of the second shoe assembly from the first shoe assembly. Therefore, the increase or decrease in distance between the cam working position and the valve 122 for the second shoe assembly relative to the first shoe assembly should be more than the increase or decrease in the overall length of the second shoe assembly with respect to the first shoe assembly. In order to establish this relationship in the change in distances between the projection 198 in the stand working position and the lug 200 and between the cam working position and the valve 122 when changing the overall length of the shoe assembly, the motor 30 moves the cam 123 towards the valve 122 at a faster speed than it moves the stand 38 and the projection 198 towards the post 26 and the lug 200.

There follows a recapitulation of the machine parts and the mode of operation of the machine that are pertinent to this invention.

The machine is intended to rough the margin 330 of the upper 326 of the shoe assembly comprised of the last 324 having the insole 328 locatd on its bottom and the upper 326 mounted thereon with the upper margin lying against and being secured to the periphery of the insole. The machine comprises the frame 212, the housing 240 mounted for forward-rearward movement with respect to the frame, the roughing tool 274 mounted to the housing for forward-rearward movement with respect to the housing about the axis of the pins 254, drive means comprised of the motor 264 for moving the roughing tool between forward and rearward positions with respect to the housing, the table 18, the slide 20 mounted to the table for movement with respect to the table, a shoe assembly support comprised of the last pin 28 and the toe pad 50 for supporting the shoe assembly bottom-up, and shoe assembly support moving means shown in FIG. 4 that includes means comprised of the rack 124 and the gear 126 for moving the slide with respect to the table to thereby move portions of the upper margin past the housing 240 and the roughing tool 274. Operating means comprised of the motor 226, the sensing member 294 and the servo follow up mechanism connecting the motor 214 and the valve 306, are effective during the movement of the upper margin portions past the housing 240 to so move housing forwardly and rearwardly as to maintain the housing in a prescribed forward-rearward relationship with respect to the periphery of the side of the shoe assembly moving past the housing so as to enable the roughing tool 274 to engage the upper margin 330 a relatively great distance inwardly of the periphery of the shoe assembly bottom when the roughing tool is in said forward positon and to enable the roughing tool to engage the upper margin a relatively small distance inwardly of the periphery of the shoe assembly bottom when the roughing tool is in said rearward position. A control member, in the form of the valve 122, is mounted to the table 18 and an actuating member, in the form of the cam 123, is mounted to the slide 20, these members being so constructed and arranged to be in intersecting relationship or non-intersecting relationship during the movement of the upper margin portions past the housing 240 and the roughing tool 274 caused by the movement of the slide 20 with respect to the table 18 during the operation of the shoe assembly support moving means. Adjusting means so connect the control member and the actuating member to the drive means as to place the roughing tool in one of its position when the members are in non-intersecting relationship and to place the roughing tool in the other of its positions when the members are in intersecting relationship.

The table 18 is in the form of a turntable mounted for rotary movement about the upright axis of the sleeve 16. The slide 20 is mounted to the turntable for reciprocal movement in two opposite prone directions between two end positions on the turntable. The shoe assembly support moving means comprises means including the clutch 146 for first moving the slide with respect to the turntable while the turntable is stationary in a first of said directins between said end positions so as to move a first side portion 344 of the upper margin 330 past the roughing tool 274 in such a manner that relative movement extending from the heel of the shoe assembly towards the toe of the shoe assembly of the roughing tool with respect to the upper margin takes place, means including the clutch 140 for thereafter rotating the turntable 18 180 degrees while the slide 20 is stationary relative to the turntable to move the toe portion of the upper margin past the roughing tool 274, and means including the clutch 132 for thereafter moving the slide with respect to the turntable while the turntable is stationary in the other of said directions between said end positions so as to move the other side portion 348 of the upper margin past the roughing tool in such a manner that relative movement extending from the toe of the shoe assembly towards the heel of the shoe assembly of the roughing tool with respect to the upper margin takes place. The control and actuating members are so constructed and arranged that the members are in non-intersecting relationship at the commencement of the slide movement in said first of said directions, the members are placed in intersecting relationship during the slide movement in said first of said directions, the members remain in intersecting relationship during the turntable rotation and after the commencement of the slide movement in said other of said directions, and the members are placed in non-intersecting relationship during the slide movement in said other of said directions. The adjusting means is so constructed and arranged as to cause the drive means 264 to place the roughing tool 274 in its forward position when the members are in non-intersecting relationship and to cause the drive means 264 to place the roughing tool 274 in its rearward position when the members are in intersecting relationship. The control member constituted by valve 122 forms a normally open regulator that is movable between open and closed positions. The actuating member constituted by the cam 123 is so constructed and arranged as to engage and thereby cause the regulator to move to its closed position during the movement of the slide 20 in said first of said directions and to disengage the regulator and thereby enable the regulator to move to its open position during the movement of the slide in said other of said directions. The adjusting means is so constructed and arranged as to cause the drive means 264 to place the roughing tool 274 in its forward position when the regulator is in its open position and to cause the drive means 264 to place the roughing tool in its rearward position when the regulator is in its closed position.

The post 26 is rigidly mounted to the slide 20 and a backpart shoe assembly supporting element, constituted by the last pin 28, for supporting the backpart of the shoe assembly is mounted to the post. The stand 38 is mounted to the slide 20 for movement towards and away from the post 26 and a forepart shoe assembly supporting element, constituted by the toe pad 50, for supporting the forepart of the shoe assembly is mounted to the stand. The motor 30 forms means for moving the stand towards the post from an initial stand position to a working stand position through a distance that is innersely proportional to the length of a shoe assembly that is supported on the backpart supporting element to thereby enable the forepart supporting element to be placed in a supportive position with respect to the forepart of the shoe assembly. This distance is determined by the engagement of the toe stop 66, that is mounted to the stand 38, with the toe end of the shoe assembly. The projection 198 mounted to the stand 38 and the lug 200 mounted to the turntable 18 constitute cooperative terminating means that define the end position reached at the end of the movement of the slide 20 with respect to the turntable 18 in said first of said directions referred to above. The actuating member constituted by the cam 123 is mounted to the stand 38 for movement in unison with the movement of the stand towards the post 26 from an initial actuating member position to a working actuating member position.

The actuating member constituted by the cam 123 is so mounted that the distance between the initial and working actuating member positions is greater than the distance between the initial and working stand positions. This is accomplished by providing connecting means that so connect the actuating member to the stand and to the turntable as to cause the actuating member to move from its initial position to its working position at a greater speed than the speed of movement of the stand from its initial position to its working position. This connecting means comprises the plate 84 rigidly connected to the stand 38 for movement in union therewith, the beam 100, to which the cam 123 is affixed, mounted to the plate for movement with respect to the plate towards and away from the regulator constituted by the valve 122, and a linkage constituted by the members 88, 92, 94, 96, 108 and 110 so connecting the slide 20, the plate 84 and the beam 100 as to enable the movement of the stand 38 towards the post 26 to cause movement of the cam 123 towards the regulator at a greater speed than the speed of movement of the stand towards the post.

I claim:

1. A machine for roughing the margin of an upper of a shoe assembly, said shoe assembly comprising a last having an insole located on its bottom and the upper mounted thereon with the upper margin lying against and being secured to the periphery of the insole, comprising: a frame; a housing mounted for forward-rearward movement with respect to the frame; a roughing tool mounted to the housing for forward-rearward movement with respect to the housing; drive means for moving the roughing tool between forward and rearward positions with respect to the housing; a table; a slide mounted to the table for movement with respect to the table; a shoe assembly support mounted to the slide for supporting the shoe assembly bottomup; shoe assembly support moving means that includes means for moving the slide with respect to the table to thereby move portions of the upper margin past the housing and the roughing tool; operating means effective during said movement of the upper margin portions past the housing to so move the housing forwardly and rearwardly as to maintain the housing in a prescribed forward-rearward relationship with respect to the periphery of the side of the shoe assembly moving past the housing thereby enabling the roughing tool to engage the upper margin a relatively great distance inwardly of the periphery of the shoe assembly bottom when the roughing tool is in said forward position and to enable the roughing tool to engage the upper margin a relatively small distance inwardly of the periphery of the shoe assembly bottom when the roughing tool is in said rearward position; a control member mounted to the table; an actuating member mounted to the slide; said members being so constructed and arranged as to be in intersecting relationship or non-intersecting relationship during the movement of the upper margin portions past the housing and the roughing tool caused by the movement of the slide with respect to the table during the operation of said shoe assembly support moving means; and adjusting means so connecting said members to the drive means as to cause the drive means to place the roughing tool in one of said positions when said members are in non-intersecting relationship and to place the roughing tool in the other of said positions when said members are in intersecting relationship.

2. The machine as defined in claim 1 wherein the table comprises a turntable mounted for rotary movement about an upright axis; wherein the slide is mounted to the turntable for reciprocal movement in two opposite prone directions between two end positions on the turntable; wherein said shoe assembly support moving means comprises: means for first moving the slide with respect to the turntable, while the turntable is stationary, in a first of said directions between said end positions so as to move a first side portion of the upper margin past the roughing tool in such a manner that relative movement extending from the heel of the shoe assembly towards the toe of the shoe assembly of the roughing tool with respect to the upper margin taken place; means for thereafter rotating the turntable 180° while the slide is stationary relative to the turntable to move the toe portion of the upper margin past the roughing tool; and means for thereafter moving the slide with respect to the turntable, while the turntable is stationary, in the other of said directions between said end positions so as to move the other side portion of the upper margin past the roughing tool in such a manner that relative movement extending from the toe of the shoe assembly towards the heel of the shoe assembly of the roughing tool with respect to the upper margin takes place; wherein said members are so constructed and arranged that said members are in said non-intersecting relationship at the commencement of said moement of the slide in said first of said directions, said members are placed in intersecting relationship during said movement of the slide in said first of said directions and remain in intersecting relationship during said turntable rotation and after the commencement of said movement of the slide in said other of said directions, and said members are placed in non-intersecting relationship during said movement of the slide in said other of said directions; and wherein said adjusting means is so constructed and arranged as to cause the drive means to place the roughing tool in said forward position when said members are in non-intersecting relationship and as to cause the drive means to place the roughing tool in said rearward position when said members are in intersecting relationship.

3. The machine as defined in claim 2 wherein said control member comprises a normally open regulator that is movable between open and closed positions;

wherein said actuating member comprises a cam, so constructed and arranged as to engage the regulator and thereby cause the regulator to move to its closed position during the movement of the slide in said first of said directions and to disengage the regulator and thereby enable the regulator to move to its open position during the movement of the slide in said other of said directions; and wherein said adjusting means is so constructed and arranged as to cause the drive means to place the roughing tool in said forward position when the regulator is in said open position and as to cause the drive means to place the roughing tool in said rearward position when the regulator is in said closed position.

4. A machine for roughing the margin of an upper of a shoe assembly, said shoe assembly comprising a last having an insole located on its bottom and the upper mounted thereon with the upper margin lying against and being secured to the periphery of the insole, comprising: a frame; a housing mounted for forward-rearward movement with respect to the frame; a roughing tool mounted to the housing for forward-rearward movement with respect to the housing; drive means for moving the roughing tool between forward and rearward positions with respect to the housing; a turntable mounted for rotary movement about an upright axis; a slide mounted to the turntable for reciprocal movement in two opposite prone directions between two end positions on the turntable; a post rigidly mounted to the slide; a backpart shoe assembly supporting element, for supporting the bakcpart of the shoe assembly, bottom-up, mounted to the post; a stand mounted to the slide for movement towards and away from the post; a forepart shoe assembly supporting element, for supporting the forepart of the shoe assembly bottom-up, mounted to the stand; means for moving the stand towards the post from an initial stand position to a working stand position through a distance that is inversely proportional to the length of a shoe assembly that is supported on the backpart supporting element to thereby enable the forepart supporting element to be placed in a supportive position with respect to the forepart of the shoe assembly; cooperative terminating means mounted to the stand and to the turntable for defining one of said end positions; means for first moving the slide with respect to the turntable while the turntable is stationary in a first of said directions between said end position to an end position defined by said terminating means so as to move a first side portion of the upper margin past the housing and the roughing tool in such a manner that relative movement extending from the heel of the shoe assembly towards the toe of the shoe assembly of the roughing tool with respect to the upper margin takes place; means for thereafter rotating the turntable 180° while the slide is stationary relative to the turntable to move the toe portion of the upper margin past the housing and the roughing tool; means for thereafter moving the slide with respect to the turntable, while the turntable is stationary in the other of said directions between said end positions so as to move the other side portion of the upper margin past the housing and the roughing tool in such a manner that relative movement extending from the toe of the shoe assembly towards the heel of the shoe assembly of the roughing tool with respect to the upper margin takes place; operating means effective during said movement of the upper margin portion past the housing to so move the housing forwardly and rearwardly as to maintain the housing in a prescribed forward-rearward relationship with respect to the periphery of the side of the shoe assembly moving past the housing thereby enabling the roughing tool to engage the upper margin a relatively great distance inwardly of the periphery of the shoe assembly bottom when the tool is in said forward position and to enable the roughing tool to engage the upper margin a relatively small distance inwardly of the periphery of the shoe assembly bottom when the tool is in said rearward position; a control member mounted to the turntable; an actuating member mounted to the stand for movement in unison with the movement of the stand towards the post from an initial actuating member position to a working actuating member position; said members being so constructed and arranged that said members are in non-intersecting relationship at the commencement of said movement of the slide in said first of said directions, that said members are placed in intersecting relationship during said movement of said slide in said first of said directions and remain in intersecting relationship during said turntable rotation and after the commencement of said movement of the slide in said other of said directions, and that said members are placed in non-intersecting relationship during said movement of the slide in said other of said directions; and adjusting means so connecting said members to the drive means as to cause the drive means to place the roughing tool in said forward position when said members are out of intersecting relationship and as to cause the drive means to place the roughing tool in said rearward position when said members are in intersecting relationship.

5. The machine as defined in claim 4 wherein said control member comprises a normally open regulator that is movable between open and closed positions; wherein said actuating member comprises a cam so constructed and arranged as to engage the regulator and thereby cause the regulator to move to its closed position during the movement of the slide in said first of said directions and to disengage the regulator and thereby enable the regulator ot move to its open position during the movement of the slide in said other of said directions; and wherein said adjusting means is so constructed and arranged as to cause the drive means to place the roughing tool in said forward position when the regulator is in said open position and as to cause the drive means to place the roughing tool in said rearward position when the regulator is in said closed position.

6. The machine as defined in claim 4 further comprising: mounting means so mounting the actuating member that the distance between the initial and working actuating member positions is greater than the distance between the initial and working stand positions.

7. The machine as defined in claim 6 wherein said mounting means comprises: connecting means so connecting the actuating member to the stand and to the turntable as to cause the actuating member to move from said initial actuating member position to the said working actuating member position at a greater speed than the speed of movement of the stand from said initial stand position to said working stand position.

8. The machine as defined in claim 7 wherein said control member comprises a normally open regulator that is movable between open and closed positions; wherein said actuating member comprises a cam so constructed and arranged as to engage the regulator and thereby cause the regulator to move to its closed position during the movement of the slide in said first of said directions and to disengage the regulator and thereby enable the regulator to move to its open position during the movement of the slide in said other of said directions; and wherein said adjusting means is so constructed and arranged as to cause the drive means to place the roughing tool in said forward position when the regulator is in said open position and as to cause the drive means to place the roughing tool in said rearward position when the regulator is in said closed position.

9. The machine as defined in claim 8 wherein said connecting means comprises: a plate reigidly fixed to the stand for movement in unison therewith; a beam, to which said cam is affixed, mounted to the plate for movement with respect to the plate towards and away from the regulator; and a linkage so connecting the slide, the plate and the beam as to enable the movement of the stand towards the post to cause movement of the cam towards the regulator at a greater speed than the speed of movement of the stand towards the post.

10. A machine for roughing the margin of an upper of a shoe assembly, said shoe assembly comprising a last having an insole located on its bottom and the upper mounted thereon with the upper margin lying against and being secured to the periphery of the insole, comprising: a frame; a housing mounted for forward-rearward movement with respect to the frame; a roughing tool mounted to the housing for forward-rearward movement with respect to the housing; drive means for moving the roughing tool between forward and rearward positions with respect to the housing; a turntable mounted for rotary movement about an upright axis; a slide mounted to the turntable for reciprocal movement in two opposite prone directions between two end positions on the turntable; a post rigidly mounted to the slide; a backpart shoe assembly supporting element, for supporting the backpart of the shoe assembly bottomup, mounted to the post; a stand mounted to the slide for movement towards and away from the post; a forepart shoe assembly supporting element, for supporting the forepart of the shoe assembly bottom-up, mounted to the stand; means for moving the stand towards the post from an initial stand position to a working stand position through a distance that is inversely proportional to the length of a shoe assembly that is supported on the backpart supporting element to thereby enable the forepart supporting element to be placed in a supportive position with respect to the foreport of the shoe assembly; cooperative terminating means mounted to the stand and to the turntable for defining one of said end positions; means for first moving the slide with respect to the turntable while the turntable is stationary in a first of said directions between said end positions to an end position defined by said terminating means so as to move a first side portion of the upper margin past the housing and the roughing tool in such a manner that relative movement extending from the heel of the shoe assembly towards the toe of the shoe assembly of the roughing tool with respect to the upper margin takes place; means for thereafter rotating the turntable 180° while the slide is stationary relative to the turntable to move the toe portion of the upper margin past the housing and the roughing tool; means for thereafter moving the slide with respect to the turntable, while the turntable is stationary, in the other of said directions between said end position so as to move the other side portion of the upper margin past the housing and the roughing tool in such a manner that relative movement extending from the toe of the shoe assembly towards the heel of the shoe assembly of the roughing tool with respect to the upper margin takes place; operating means effective during said movement of the upper margin portions past the housing to so move the housing forwardly and rearwardly as to maintain the housing in a prescribed forward-rearward relationship with respect to the periphery of the side of the shoe assembly moving past the housing thereby enabling the roughing tool to engage the upper margin a relatively great distance inwardly of the periphery of the shoe assembly bottom when the tool is in said forward position and to enable the roughing tool to engage the upper margin a relatively small distance inwardly of the periphery of the shoe assembly bottom when the tool is in said rearward position; a control member mounted to the turntable; an actuating member mounted to the stand for movement in unison with the movement of the stand towards the post from an initial actuating member position to a working actuating member position and mounted for movement with the slide in said directions, the mounting of the actuating member to the stand being so constructed and arranged that the distance between the initial and working actuating member positions is greater than the distance between the initial and wokring stand positions; said members being so constructed and arranged as to be in non-intersecting relationship at the beginning of the slide movement in said first of said directions and at the end of the slide movement in said other of said directions and to be in intersecting relationship during at least a first prescribed portion of the slide movement in said first of said directions and during a second prescribed portion of the slide movement in said other of said directions; and adjusting means so connecting said members to the drive means as to cause the drive means to place the tool in one of said positions when said members are in non-intersecting relationship and to place the tool in the other of said positions when said members are in intersecting relationship.

11. The machine as defined in claim 10 wherein said mounting of the actuating member comprises: connecting means so connecting the actuating member to the stand and to the turntable as to cause the actuating member to move from said initial actuating member position to said working actuating member position at a greater speed than the speed of movement of the stand from said initial stand position to said working stand position.

12. The machine as defined in claim 11 wherein said control member comprises a normally open regulator that is movable between open and closed positions; wherein said actuating member comprises a cam so constructed and arranged as to engage the regulator and thereby cause the regulator to move to its closed position during the movement of the slide in said first of said directions and to disengage the regulator and thereby enable the regulator to move to its open position during the movement of the slide in said other of said directions; and wherein said adjusting means is so constructed and arranged as to cause the drive means to place the roughing tool in said forward position when the regulator is in said open position and as to cause the drive means to place the roughing tool in said rearward position when the regulator is in said closed position.

13. The machine as defined in claim 12 wherein said connecting means comprises: a plate rigidly fixed to the stand for movement in unison therewith; a beam, to which said cam is affixed, mounted to the plate for movement with respect to the plate towards and away from the regulator; and a linkage so connecting the slide, the plate and the beam as to enable the movement of the stand towards the post to cause movement of the cam towards the regulator at a greater speed than the speed of movement of the stand towards the post.

* * * * *

UNITED STATES PATENT AND TRADEMARK OFFICE

CERTIFICATE OF CORRECTION

PATENT NO. : 4,020,660

DATED : May 3, 1977

INVENTOR(S) : Normand Bergeron

It is certified that error appears in the above-identified patent and that said Letters Patent are hereby corrected as shown below:

Column 1: line 47, change "inwrdly" to --inwardly--.

Column 4: line 52, change "180" to --130--; line 57, change "a" to --A--.

Column 9: line 67, change "366" to --336--.

Column 12: line 11, change "1" to --196--; line 12, change "porjection" to --projection--; line 15, change "aproximate" to --approximate--; line 20, change "statinary" to --stationary--.

Column 14: line 28, change "directins" to --directions--; line 37, change "assmebly" to --assembly--.

Column 19: line 31, change "bakcpart" to --backpart--.

Signed and Sealed this

*Third* Day of *July 1979*

[SEAL]

*Attest:*

*Attesting Officer*

LUTRELLE F. PARKER

*Acting Commissioner of Patents and Trademarks*